US008795096B2

(12) United States Patent
Stoker

(10) Patent No.: US 8,795,096 B2
(45) Date of Patent: Aug. 5, 2014

(54) MOTION RIDE METHOD AND APPARATUS FOR ILLUSION OF TELEPORTATION

(76) Inventor: Daniel James Stoker, Tucson, AZ (US)

( * ) Notice: Subject to any disclaimer, the term of this patent is extended or adjusted under 35 U.S.C. 154(b) by 109 days.

(21) Appl. No.: 13/483,973

(22) Filed: May 30, 2012

(65) Prior Publication Data

US 2013/0324271 A1 Dec. 5, 2013

(51) Int. Cl.
*A63J 21/00* (2006.01)

(52) U.S. Cl.
USPC ..... 472/71

(58) Field of Classification Search
CPC ..... A63J 21/00; B66B 3/008; B66B 3/00
USPC ..... 472/71, 131, 58; 187/414; 446/130
See application file for complete search history.

(56) References Cited

U.S. PATENT DOCUMENTS

| | | | | |
|---|---|---|---|---|
| 2,187,963 | A * | 1/1940 | Bartlett | 472/59 |
| 4,026,066 | A * | 5/1977 | Reiner et al. | 446/236 |
| 4,953,848 | A * | 9/1990 | Braunstein et al. | 40/538 |
| 5,041,044 | A * | 8/1991 | Weinreich | 446/130 |
| 5,865,519 | A * | 2/1999 | Maass | 353/28 |
| 6,076,638 | A * | 6/2000 | Gertz | 187/414 |
| 6,629,895 | B2 * | 10/2003 | Uemura et al. | 472/60 |
| 7,338,176 | B2 * | 3/2008 | Svensson-Hilford et al. | 353/122 |
| 7,931,539 | B2 * | 4/2011 | Chen | 472/2 |
| 2008/0146356 | A1 * | 6/2008 | Gaughan | 472/58 |

* cited by examiner

*Primary Examiner* — Michael Dennis

(57) ABSTRACT

A method and apparatus for a motion ride that creates the illusion of teleportation on passengers in a passenger vehicle. This is accomplished in four steps of the method. Multiple embodiments of varying apparatus are presented for completing the four steps of the method. Passengers in the first step view a primary environment, in the second step passengers are surrounded by a secondary environment, in the third step passengers experience Galilean invariance by viewing the velocity of multiple of images of motion of the secondary environment being relative to the velocity of the passenger vehicle as selected from a group consisting of equal magnitude and same direction, equal magnitude and opposite direction, greater magnitude and same direction, greater magnitude and opposite direction, lesser magnitude and same direction, and lesser magnitude and opposite direction, and in the fourth step passengers again view the primary environment.

9 Claims, 13 Drawing Sheets

327
323
325
325
Perceived
Final Destination 321
329
315
319
Actual
Final Destination
307
301
335
333
317
311
303
303
301
329
305
301
301
309
303
303
335
331
329
313

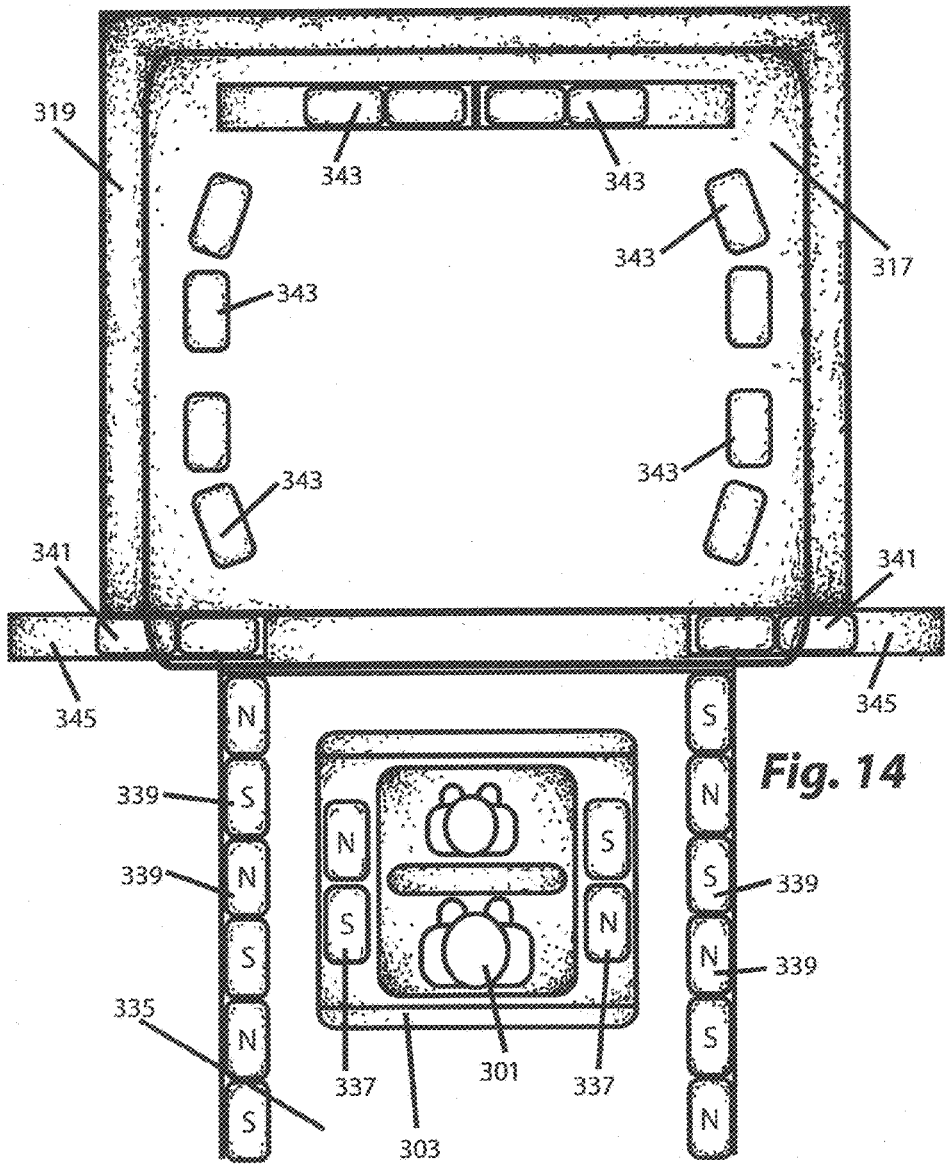
319
343
343
343
317
343
343
343
341
341
345
345
339
339
335
N
S
N
S
N
S

MOTION RIDE METHOD AND APPARATUS FOR ILLUSION OF TELEPORTATION

FIELD OF THE INVENTION

The current invention relates to, but not exclusively, motion rides, dark rides, amusement park attractions, carnival illusions, and themed rides. The current invention also relates to methods and apparatus that aid in creating the illusion of teleportation.

BACKGROUND OF THE INVENTION

The science fiction wonderment of human teleportation has captured the imaginations of millions for centuries. Some of the earliest writings on the concept (i.e. Aladdin from The Book of One Thousand and One Nights) provided the first spark for what has turned out to be a long and enduring interest over its technical possibility. Though early scientific studies of the concept offered no solutions, an array of stage illusions fabricated by magicians were developed with great craft and enthusiasm to meet the demands of curious minds. Audiences were treated to such illusions by magicians operating and utilizing trick devices (i.e. secret trapdoors or undisclosed identities of twins) in order to manipulate viewers into believing that teleportation had occurred right before their eyes. For years now, performing such acts has been routinely accomplished with the aid of stage actors; however, creating the reverse illusion of convincing the audience that they themselves have been teleported has proved to be a much greater challenge. Furthermore, the landscape of popular audience entertainment in the last century has shifted dramatically away from static auditorium viewing to dynamic motion ride experiences.

Rise in popularity of amusement parks had ushered in a new type of audience entertainment as ride designers emerged with diverse engineering talents for creating extraordinary passenger ride journeys. Early amusement rides explored uses of manufactured background and foreground elements representing exotic locations like a prehistoric land of dinosaurs or the Moon and were often accompanied by varied impulse motions for creating physical sensations of movement. These rides and their modern counterparts, however, assume the task of creating powerful scenery and vehicle accelerations for encouraging passengers to imagine they are traveling to and then in these incredible worlds. Consequently, traditional methods and apparatus of modern amusement rides are limited in the full range of motion effects they can ultimately create on passengers, especially in regards to themes of ride journeys of remarkable destinations and fantastic modes of transportation.

Publications of the most closely related, but only partially related, technologies to the current invention are discussed in detail in the following sections. Though, before discussing these publications, definitions for commonly used identifications of elements and processes of the current invention are explained thoroughly as their technical importance is not currently present in sufficient discussion in any motion ride publications. This lack of technical distinction of these elements and processes is an indication of the unique and unobvious nature of the current invention as a complete listing of identifications of these technical distinctions are critical for understanding, developing, and identifying the current invention and the synergistic effects it creates.

A primary environment is identified in this publication as an area outside of a secondary environment that a passenger vehicle of a motion ride moves through with no effects of relative illusion of motion. A secondary environment is identified in this publication as an area that surrounds a passenger vehicle of a motion ride as the passenger vehicle moves through the secondary environment and experiences a relative illusion of motion resulting from the secondary environment presenting having multiple images of motion of the secondary environment. These multiple images of motion can be created by real images of the secondary environment moving or by artificial images displayed by the secondary environment creating images of motion of the secondary environment. A relative illusion of motion is identified in this publication as observed relative motion by passengers in a moving passenger vehicle of a secondary environment presenting having multiple images of motion of the secondary environment in the field of vision of the passengers. A perceived final destination is identified in this publication as the location of a moving passenger vehicle in reference to a primary environment as anticipated by the passengers of the passenger vehicle directly following an experienced relative illusion of motion and based upon the location of the passenger vehicle in the primary environment prior to the relative illusion of motion and further based upon the state dynamics of the relative illusion of motion. An actual final destination is identified in this publication as the true location of a moving passenger vehicle in reference to a primary environment directly following a relative illusion of motion.

Previous and current motion rides explore uses of relative motion of scenery for creating the illusion of fantastic voyages and adventures. U.S. Pat. No. 2,817,963 utilizes a pair of tunnels and a pair of drums for the brief exposure of relative illusion of motion to a passenger passing through the described objects. The entire ride, however, is designed so that all perceived final destinations correlate to actual final destinations and therefore the relative illusion of motion has no effect beyond the motion itself. This manner of use of relative illusion of motion is found most commonly among motion rides from the end of the $19^{th}$ Century and the early $20^{th}$ Century when such techniques were stirring intense interest among amusement park attendees. This may be correlated to scientific, artistic, and philosophical revolutions of the time that include Albert Einstein's theory of Special Relativity, H. G. Well's *The Time Machine*, and Edwin Abbott Abbott's *Flatland* that challenged preconceived notions of universal concepts like space, time, and our motion through both.

For example, the use of " . . . endless aprons at the sides thereof though which flashes of light are discernible . . . " in U.S. Pat. No. 1,048,152 for the relative illusion of motion of passengers in an elevator creates the illusion of descending motion correlating to a perceived final destination of "Hell" (with the actual final destination represented with scenery of "Hell"). In other words, the passengers are provided the illusion of motion of traveling down and are then presented with an actual final destination of a location that correlates to being at an elevation lower than passengers were previously located prior to this relative illusion of motion. A difference between perceived and actual final destination would have been a creation of scenery of the Moon or "Heaven" with correlating elements for a location in space or in the sky, respectively, following the relative illusion of motion of the descending mechanism. This, however, is not the case in this technology or any other existing motion ride designs. After the "Hell" experience, passengers are loaded onto another elevator with a relative illusion of motion of ascending motion from which follows a same location of perceived final destination and actual final destination as passengers are returned to the ground level.

The same limiting effect of relative illusion of motion with perceived final destinations always being the same as actual final destinations is found in U.S. Pat. No. 530,128, U.S. Pat. No. 556,340, U.S. Pat. No. 590,783, U.S. Pat. No. 739,236, U.S. Pat. No. 754,532, U.S. Pat. No. 788,886, U.S. Pat. No. 797,372, U.S. Pat. No. 847,724, U.S. Pat. No. 847,725, U.S. Pat. No. 853,898, U.S. Pat. No. 872,627, U.S. Pat. No. 887,803, U.S. Pat. No. 1,048,152, U.S. Pat. No. 1,340,570, U.S. Pat. No. 1,833,540, U.S. Pat. No. 2,069,664, U.S. Pat. No. 2,201,993, U.S. Pat. No. 2,941,333, U.S. Pat. No. 6,076,638, U.S. Pat. No. 6,412,360, and U.S. Pat. No. 6,629,895.

From reviewing the patent publications listed above, it is found that previous and current uses of relative illusion of motion upon a passenger or passengers exists among inventions focused solely on the motion effect and not on additional, complex, and unique effects generated from this initial effect (i.e. creating the illusion of teleportation). In other words, the effect of relative illusion of motion has always been used to compliment the journey and perceived final destination of the ride which is in absolute contrast to the current invention. This has created a thicket of overused ride experiences that passengers are greatly accustomed to with common expectations and anticipations of ride mechanisms using relative illusion of motion. The failure of current ride technologies to use relative illusion of motion for effects like creating the illusion of teleportation is further verified by documentation of a complete lack of mention of creation of illusion of teleportation on a group of passengers in a ride vehicle in any of the patent publications of this group, or any other group, of motion rides.

Public technologies with a few but limited similarities to the current invention include two ride experiences found in the Disneyland Park in Anaheim, Calif. (with similar constructions in other Disney amusement parks around the World). The Haunted Mansion ride in the themed area of "New Orleans Square" transports passengers by a large OTIS elevator. The elevator is only partially encapsulating riders giving the impression during operation that the elevator room is "stretching" as some elements of the room do not move with the elevator. This is not done in any manner to give the illusion of teleportation as passengers are transported to another room of the "mansion" that fulfils the anticipated progression of travel through the themed ride. In a similar fashion, the Indiana Jones Adventure ride in "Adventureland" uses a movable structure for partially encapsulating riders of a stationary vehicle and creating an illusion of motion around the vehicle. This motion created by a partially surrounding wall briefly provides the illusion that the vehicle is moving backwards. This, however, does not provide any illusion of teleportation as passengers are moved into another room of the "temple" that is an area anticipated within the themed ride. Tony Baxter, Senior Vice President of Creative Development of Disney Imagineering, remarks in the 2000 DVD release Disneyland Resort, Imagineering the Magic that this effect—the brief illusion of motion of a vehicle that is stationary—is similar to an experience in a vehicle within a car wash. There is no mention of a goal of creating the illusion of teleportation. Also, this is not a relative illusion of motion as identified in this publication as the ride vehicle is not reported to be moving during motion of the wall.

In regards to public technologies that do mention teleportation, such publications are not found within fields of motion rides or amusement park attractions but in fields of video gaming in virtual space (virtual teleportation), magician acts (stage actor teleportation), and physics applications that contain elaborate detailing of scientific principles suggesting the possibility of teleportation by laws of quantum mechanics (i.e. quantum entanglement) or general relativity (i.e. Einstein-Rosen bridge), respectively.

In summary, the employment of relative illusion of motion has been used historically to create the effect solely for that purpose with any anticipation of a ride destination (perceived final destination) of a motion ride experience always being in the same location as the actual final destination of the motion ride. Consequently, no previous or current technology uses relative illusion of motion for creating the illusion of teleportation on a multiple of passengers in a passenger vehicle.

OBJECTIVES & ADVANTAGES OF THE INVENTION

It was discussed previously that traditional methods and apparatus of modern amusement rides are limited in the full range of motion effects they can ultimately create on passengers. These rides and their modern counterparts assume the task of creating powerful scenery and vehicle accelerations that encourage passengers to imagine they are traveling to and then in incredible worlds.

The departure from these past and modern approaches is a new technology, presented in the current invention, that moves away from trying to convince passengers that they are traveling to and then in a new destination but rather impart to them the experience that they have traveled to a perceived but false final destination and then reveal to them the actual final destination they have arrived to. With the passengers so heavily invested in believing and anticipating this perceived final destination of the passenger vehicle, from an observed relative illusion of motion, the sudden presentation of the actual final destination of the passenger vehicle will be almost unbelievable. Passengers will interpret the event as the passenger vehicle being moved instantaneously from the perceived final destination to the actual final destination.

Any themed ride or attraction could be molded around the effect of this method for complimenting a science fiction or fantasy teleportation event (i.e. The Fly or Harry Potter). It would be an entirely new experience for any amusement ride enthusiast and for many may even be nearly impossible to explain upon seeing firsthand as the technical mechanisms behind this effect are complex and not immediately apparent or obvious. It is explained in subsequent sections how creating the illusion of teleportation in the current invention relies on a four step method that creates relative illusion of motion for separating locations of perceived final destination and actual final destination following the relative illusion of motion as observed by passengers of the motion ride.

SUMMARY OF THE INVENTION

The current invention is a four step method and apparatus for a motion ride that creates the illusion of teleportation on a multiple of passengers in a passenger vehicle. Multiple embodiments of diverse type and use of apparatus are presented for completing the four steps of the method. The first step is moving a passenger vehicle carrying a multiple of passengers through a primary environment with the primary environment in the field of vision of the multiple of passengers and the primary environment being an area outside of a secondary environment. The second step is moving the passenger vehicle carrying the multiple of passengers out of the primary environment and into the secondary environment so that the primary environment is not within the field of vision of the multiple of passengers. The third step is moving the passenger vehicle carrying the multiple of passengers with a second velocity and creating a multiple of images of motion of the secondary environment in the field of vision of the multiple of passengers with a first velocity simultaneously for a finite amount of time with the first velocity of the multiple of images of motion of the secondary environment being relative to the second velocity of the passenger vehicle as selected from a group consisting of equal magnitude and same direction, equal magnitude and opposite direction, greater magnitude and same direction, greater magnitude and opposite direction, lesser magnitude and same direction, and lesser magnitude and opposite direction. The fourth step is moving the passenger vehicle carrying the multiple of passengers out of the secondary environment and into the primary environment with the primary environment in the field of vision of the multiple of passengers.

The strongest advantage of the current invention over all other similar technologies is the unique and highly effective four step method of the current invention for creating the illusion of teleportation on a multiple of passengers in a passenger vehicle. This is further indicated by a complete lack of finding of the four steps of the method of the current invention in any other public technologies to date. Such a lack of finding of these four steps of the method of the current invention verifies that no other technology creates the synergistic effects resulting from the manner of use of relative illusion of motion as described in the multiple embodiments of the current invention.

BRIEF DESCRIPTION OF THE DRAWINGS

FIG. 14 is an aerial view in cutaway illustrating a portion of part of a floor and tower of a motion ride for creating the illusion of teleportation. Multiple passengers in a variably magnetized automated guided vehicle with multiple variably magnetized automated guided vehicle components are traveling along a variably magnetized ride track with multiple variably magnetized ride track components and moving into a variably magnetized ride elevator surrounded by a movable elevator shaft.

Figures 1, 2:
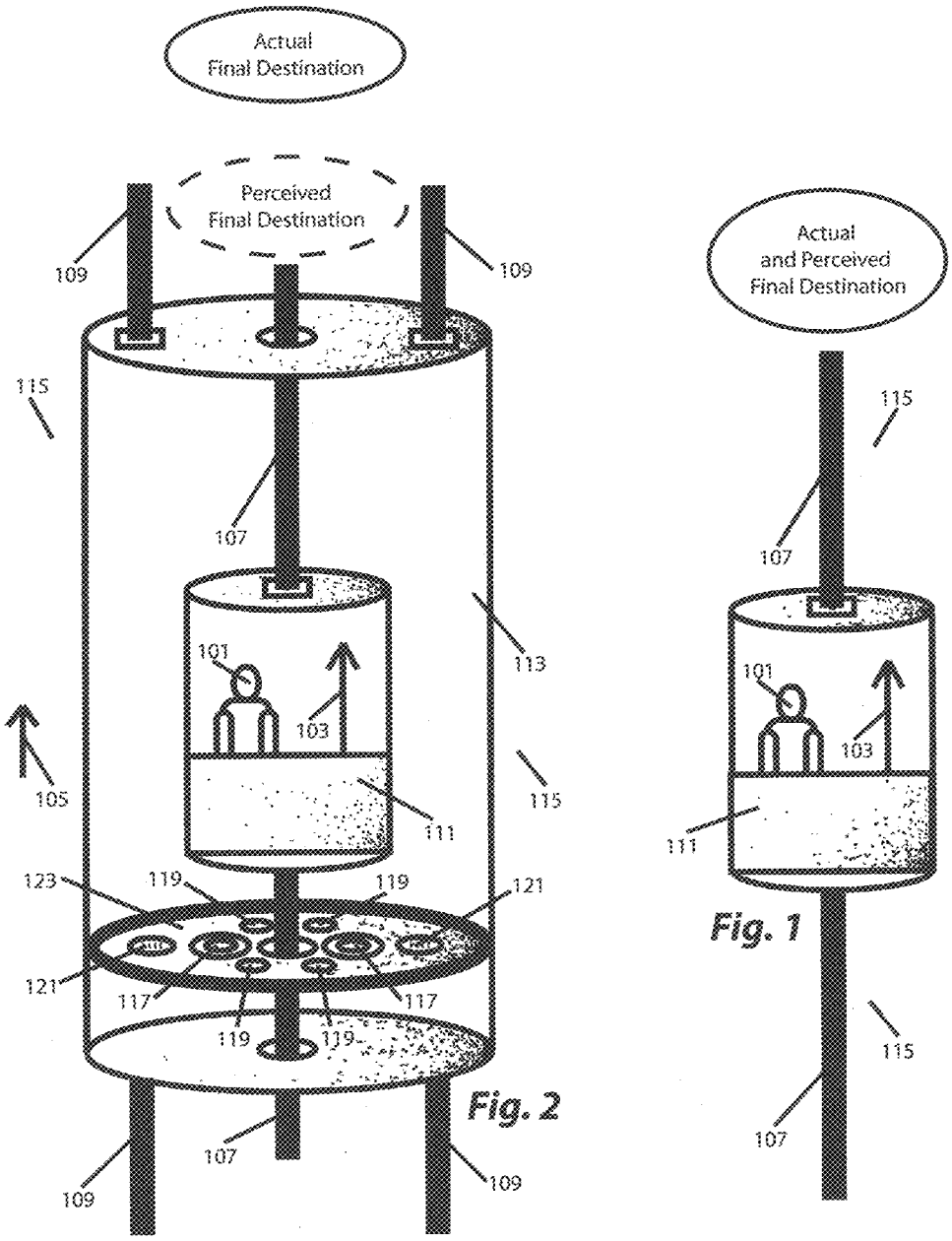
FIG. 1 is a front view in cutaway illustrating a portion of part of a motion ride for creating the illusion of teleportation. A passenger has a field of vision of a primary environment while moving in a ride elevator.
FIG. 2 is a front view in cutaway illustrating a portion of part of a motion ride for creating the illusion of teleportation. A passenger moving in a ride elevator has a field of vision of a movable elevator shaft surrounding the ride elevator. The movable elevator shaft has a first velocity that is of a lesser magnitude and in the same direction relative to a second velocity of the ride elevator.

The following list identifies all elements of all figures of the current invention by numbering and brief descriptive titles of these elements.

ELEMENTS AND DESCRIPTIONS

Table of Element Numbers and Element Descriptive Titles

| Element Number | Element Descriptive Title |
|---|---|
| 101 | Passenger |
| 103 | Second Velocity |
| 105 | First Velocity |
| 107 | Ride Elevator Cable |
| 109 | Movable Elevator Shaft Cable |
| 111 | Ride Elevator (Passenger Vehicle) |
| 113 | Movable Elevator Shaft (Secondary Environment) |
| 115 | Primary Environment |
| 117 | Movable Elevator Shaft Platform Light |
| 119 | Movable Elevator Shaft Platform Air Fan |
| 121 | Movable Elevator Shaft Platform Speaker |
| 123 | Movable Elevator Shaft Platform |
| 125 | Movable Elevator Shaft Pulley |
| 127 | Ride Elevator Pulley |
| 201 | Passenger |
| 203 | Second Velocity |
| 205 | First Velocity |
| 207 | Ride Car Track |
| 209 | Ride Car (Passenger Vehicle) |
| 211 | Movable Ride Tunnel (Secondary Environment) |
| 213 | Movable Ride Tunnel Display Panel |
| 215 | Primary Environment |
| 217 | Ride Tunnel Conveyor Belt |

-continued

Table of Element Numbers and Element Descriptive Titles

| Element Number | Element Descriptive Title |
|---|---|
| 301 | Passenger |
| 303 | Variably Magnetized Automated Guided Vehicle (Passenger Vehicle) |
| 305 | Elevator Entrance |
| 307 | Elevator Exit |
| 309 | Middle Floor |
| 311 | Upper Floor |
| 313 | Lower Floor |
| 315 | Movable Elevator Shaft Platform |
| 317 | Variably Magnetized Ride Elevator |
| 319 | Movable Elevator Shaft (Secondary Environment) |
| 321 | Ride Elevator Cable |
| 323 | Tower |
| 325 | Movable Elevator Shaft Cable |
| 327 | Cables and Pulley System |
| 329 | Primary Environment |
| 331 | First Velocity |
| 333 | Second Velocity |
| 335 | Variably Magnetized Ride Track |
| 337 | Variably Magnetized Automated Guided Vehicle Component |
| 339 | Variably Magnetized Ride Track Component |
| 341 | Variably Magnetized Ride Elevator Door Component |
| 343 | Variably Magnetized Ride Elevator Component |
| 345 | Variably Magnetized Ride Elevator Door |
| 401 | First Step of the Method |
| 403 | Second Step of the Method |
| 405 | Third Step of the Method |
| 407 | Fourth Step of the Method |

DETAILED DESCRIPTION OF THE PREFERRED EMBODIMENTS

FIGS. 1, 2, 3, 4, 5, 6, 7, 8, 9, 10, 11, 12, 13, 14, 15*a*, and 15*b* present apparatus of three embodiments of the current invention. Each embodiment uses a different collection of apparatus for operating a motion ride but each motion ride accomplishes all four steps of the method of the current invention according to the detailed description of the four steps of the method presented in FIG. 16.

This four step method of the current invention creates relative illusion of motion by surrounding a passenger vehicle with a secondary environment and simultaneously for a finite amount of time having passenger vehicle moving while secondary environment presenting having multiple images of motion of the secondary environment. As previously identified, the multiple images of motion of the secondary environment can be created by real images of the secondary environment moving or by artificial images displayed by the secondary environment creating multiple artificial images of motion of the secondary environment. With passengers having no frame of reference beyond themselves and the secondary environment during motion of the passenger vehicle and multiple images of motion of the secondary environment, relative illusion of motion is created as their perceived motion of the passenger vehicle is affected by the natural phenomena of Galilean invariance. In Galilean invariance two objects with independent velocities but with only sight of one and each other experience observations of relative motion.

Galilean invariance used for the current invention for creating the illusion of teleportation is a unique method of utilization of relative illusion of motion as the effect of this relative illusion of motion will create in the mind of the passengers an anticipated or perceived final destination of the passenger vehicle that is separate from the actual final destination of the passenger vehicle. Furthermore, the intensity of the effect is dependent on the magnitudes and directions of velocities of both the passenger vehicle and the images of motion of the secondary environment and durations of both of these velocities. The full spectrum of effects of this relative illusion of motion for creating the illusion of teleportation on passengers of a passenger vehicle is accomplished when the velocity of the secondary environment is relative to the velocity of the passenger vehicle as selected from a group consisting of equal magnitude and same direction, equal magnitude and opposite direction, greater magnitude and same direction, greater magnitude and opposite direction, lesser magnitude and same direction, and lesser magnitude and opposite direction.

Consequently, if the secondary environment velocity can be defined according to the passenger vehicle velocity relatively by one of the terms of this group then the anticipated or perceived final destination of the passenger vehicle as imagined in the mind of the passengers is not the same location as the actual final destination of the passenger vehicle. Presenting to the passengers the actual final destination of the passenger vehicle following the relative illusion of motion creates the illusion in the mind of the passengers that they have instantaneously moved from the perceived final destination to the actual final destination. This is then an illusion of teleportation as the definition of teleportation by the Oxford Dictionary (2012) defines the act of teleportation as to "transport or be transported across space and distance instantly."

The four steps of the method of the current invention for creating the illusion of teleportation are essential. It is important that in a first step of the method 401 (FIG. 16), passengers have the primary environment in their field of vision prior to becoming surrounded by the secondary environment as it establishes the baseline in their mind for location of the passenger vehicle relative to the primary environment and prior to relative illusion of motion. In a second step of the method 403 (FIG. 16), the passenger vehicle is moved from the primary environment to the secondary environment so that the primary environment is removed from the field of vision of the passengers. It is important for relative illusion of motion to occur in a third step of the method 405 (FIG. 16) when the primary environment is no longer in the field of vision of the passengers as the primary environment would provide a frame of reference for determining the velocity of multiple images of motion of the secondary environment as presented by the secondary environment. The passengers inability to determine the velocity of multiple images of motion of the secondary environment as presented by the secondary environment in regards to being less, equal, or greater in magnitude and in the same or opposite direction to the velocity of the passenger vehicle is a key mechanism behind creating the relative illusion of motion. A fourth step of the method 407 (FIG. 16) is presenting the primary environment into the field of vision of the passengers to reveal the actual final location of the passenger vehicle relative to the primary environment thus completing the effect of creating the illusion of teleportation.

The first embodiment of the current invention utilizes vertical motion apparatus along with the four step method of the current invention for creating the illusion of teleportation as presented in FIGS. 1, 2, 3, and 4. The apparatus identified for the first embodiment provides for completing all four steps of the method and technical details are focused only on completing the method of the current invention and not on other widely understood and common motion ride and mechanical transportation practices like the loading and unloading of persons. Furthermore, the front portion of the secondary environment has been cutaway to allow illustration of critical technical details of the apparatus used in the first embodiment as presented in FIGS. 2 and 3. Otherwise, during operation of the motion ride the front portion of the curved wall of the secondary environment will completely surround the passenger vehicle during relative illusion of motion.

In FIG. 1, a front view in cutaway illustrating a portion of part of a motion ride for creating the illusion of teleportation for a first embodiment of the current invention shows a passenger 101 with field of vision of a primary environment 115 and moving in a passenger vehicle of a ride elevator 111 with a second velocity 103. Passenger 101 has an actual final destination and a perceived final destination that are in the same location as there is no relative illusion of motion experienced. This is a common ride experience as a ride elevator cable 107 pulls ride elevator 111 in a vertical motion. This would be the state of motion for an entire ride that experiences no relative illusion of motion. This is, however, the state of motion of passenger 101 in first step of the method 401 (FIG. 16) and fourth step of the method 407 (FIG. 16) of the current invention for illusion of teleportation. This is the also the process for completing second step of the method 403 (FIG. 16) as ride elevator 111 moves passenger 101 into a movable elevator shaft 113 (FIGS. 2 and 3).

In FIG. 2, a front view in cutaway illustrating a portion of part of a motion ride for creating the illusion of teleportation for a first embodiment of the current invention shows passenger 101 with field of vision of secondary environment of movable elevator shaft 113. Movable elevator shaft 113 surrounds passenger vehicle of ride elevator 111 carrying passenger 101. Movable elevator shaft 113 has a first velocity 105 that is of a lesser magnitude and in a same direction relative to second velocity 103 of ride elevator 111. This is a unique ride experience as passenger 101 experiences a relative illusion of motion that creates separated locations of the actual final destination and perceived final destination of ride elevator 111. The effect of this relative illusion of motion results in passenger 101 anticipating a perceived final destination of ride elevator 111 that is a shorter distance than the distance of the actual final destination of ride elevator 111. FIG. 2 represents a first operation of the first embodiment of the motion ride apparatus based upon velocities of movable elevator shaft 113 and ride elevator 111.

Figure 16:
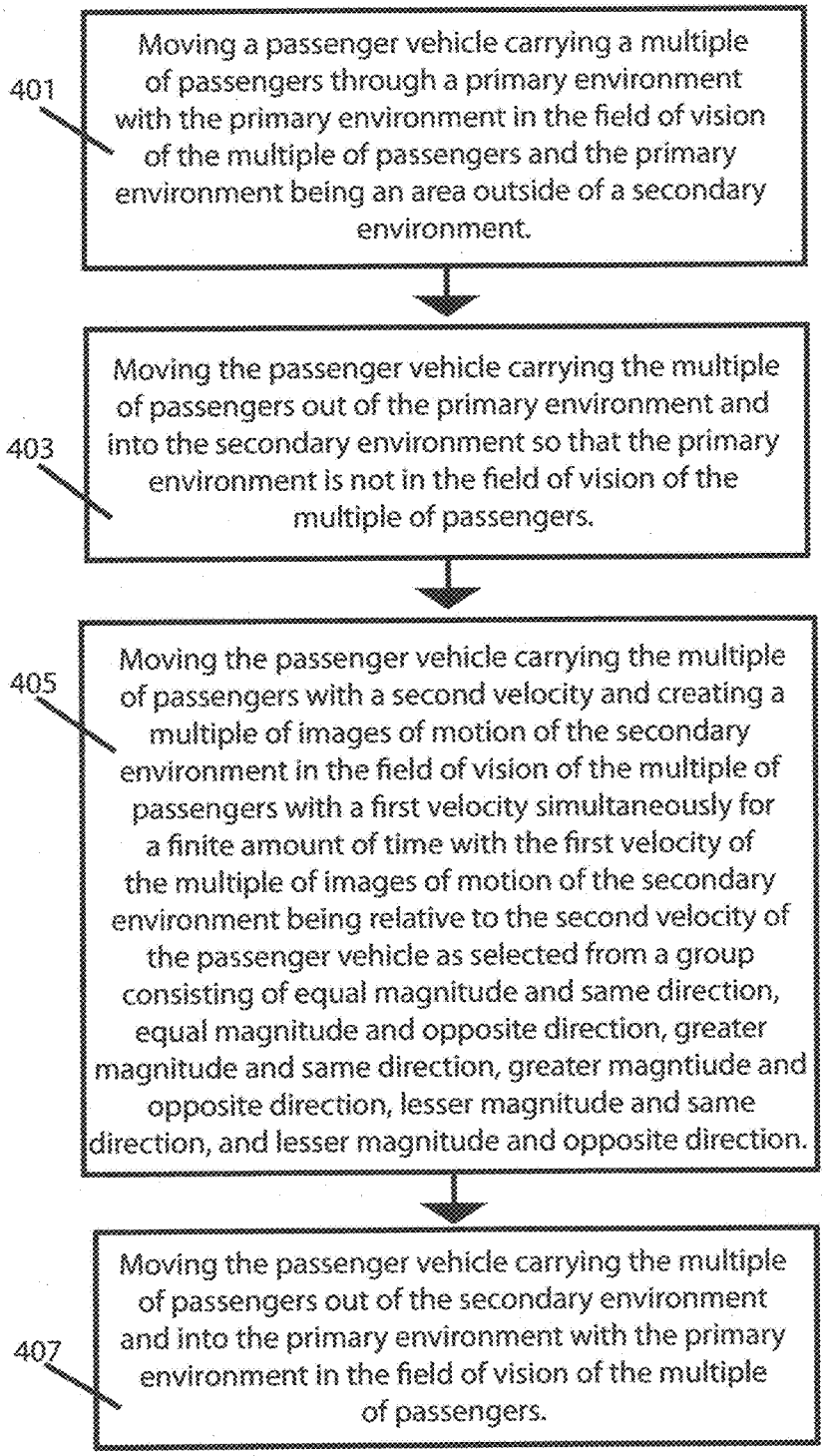
FIG. 16 is a flowchart of four steps of the method of the current invention for creating the illusion of teleportation on a multiple of passengers within a passenger vehicle of a motion ride.

The distance between the actual final destination and perceived final destination can be relatively short or long depending on the magnitudes of first velocity 105 and second velocity 103 and depending on durations of motion of ride elevator 111 and movable elevator shaft 113 during relative illusion of motion. This is the state of motion of passenger 101 in the third step of the method 405 (FIG. 16). The full effect is accomplished after this relative illusion of motion by presenting primary environment 115 in field of vision of passenger 101 showing the actual final destination of ride elevator 111 and therefore completing the illusion of teleportation as occurring from perceived final destination to actual final destination. For enhancing the effect of relative illusion of motion for the illusion of teleportation, a movable elevator shaft platform 123 is housing multiple of a movable elevator shaft platform light 117, multiple of a movable elevator shaft platform air fan 119, and multiple of a movable elevator shaft platform speaker 121. Effects of lighting, sound, and forced air can be created by these elements of movable elevator shaft platform 123 to complement the relative illusion of motion.

Figure 3:
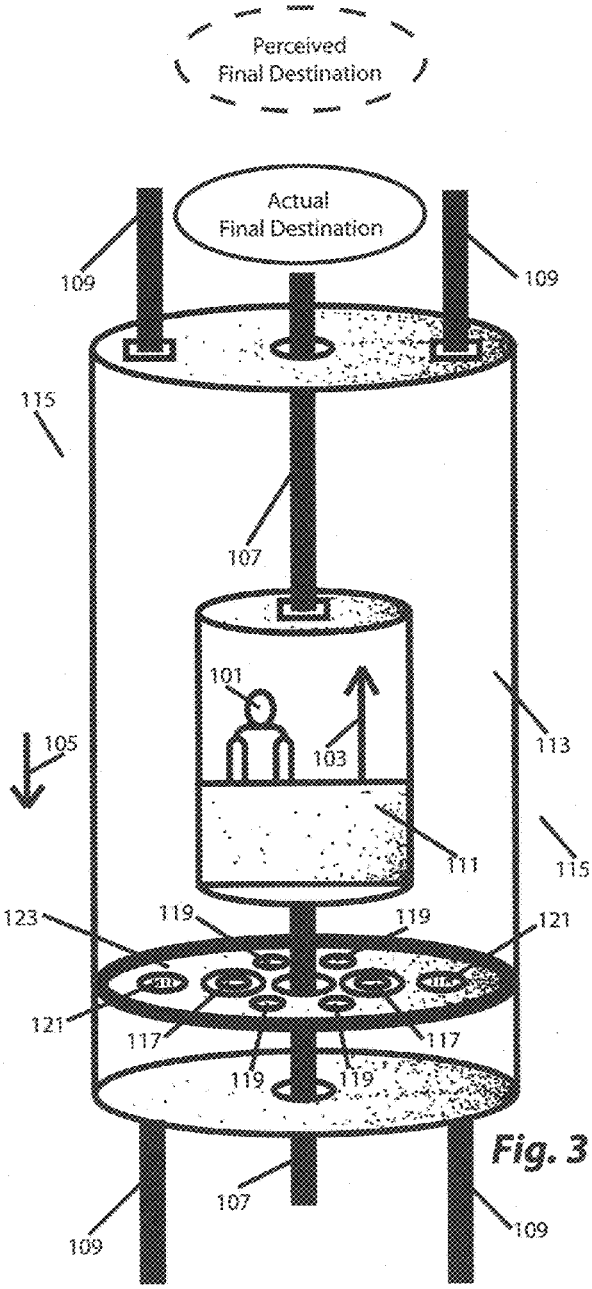
FIG. 3 is a front view in cutaway illustrating a portion of part of a motion ride for creating the illusion of teleportation. A passenger moving in a ride elevator has a field of vision of a movable elevator shaft surrounding the ride elevator. The movable elevator shaft has a first velocity that is of a lesser magnitude and in the opposite direction relative to a second velocity of the ride elevator.

In FIG. 3, a front view in cutaway illustrating a portion of part of a motion ride for creating the illusion of teleportation for a first embodiment of the current invention shows passenger 101 with field of vision of secondary environment of movable elevator shaft 113. Movable elevator 113 surrounds passenger vehicle of ride elevator 111 carrying passenger 101. Movable elevator shaft 113 has first velocity 105 that is of a lesser magnitude and in an opposite direction relative to second velocity 103 of ride elevator 111. This is a unique ride experience as passenger 101 experiences a relative illusion of motion that creates separated locations of the actual final destination and perceived final destination of ride elevator 111. The effect of this relative illusion of motion results in passenger 101 anticipating a perceived final destination of ride elevator 111 that is a longer distance than the distance of the actual final destination of ride elevator 111. FIG. 3 represents a second operation of the first embodiment of the motion ride apparatus based upon velocities of movable elevator shaft 113 and ride elevator 111.

The distance between the actual final destination and perceived final destination can be relatively short or long depending on the magnitudes of first velocity 105 and second velocity 103 and depending on durations of motion of ride elevator 111 and movable elevator shaft 113 during relative illusion of motion. This is the state of motion of passenger 101 in the third step of the method 405 (FIG. 16). The full effect is accomplished after this relative illusion of motion by presenting primary environment 115 in field of vision of passenger 101 showing the actual final destination of ride elevator 111 and therefore completing the illusion of teleportation as occurring from perceived final destination to actual final destination. For enhancing the effect of relative illusion of motion for the illusion of teleportation, movable elevator shaft platform 123 is housing multiple of movable elevator shaft platform light 117, multiple of movable elevator shaft platform air fan 119, and multiple of movable elevator shaft platform speaker 121. Effects of lighting, sound, and forced air can be created by these elements of movable elevator shaft platform 123 to complement the relative illusion of motion.

Figure 4:
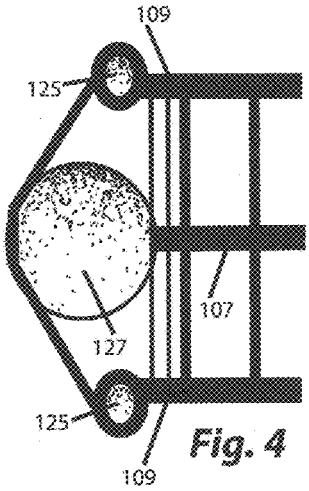
FIG. 4 is a cables and pulley system, part of a motion ride for creating the illusion of teleportation, composed of a multiple of a movable elevator shaft pulley attached to a multiple of a movable elevator shaft cable and a ride elevator pulley attached to a ride elevator cable.

In FIG. 4, a cables and pulley system, part of a motion ride for creating the illusion of teleportation, composed of multiple of a movable elevator shaft pulley 125 attached to multiple of movable elevator shaft cable 109 and a ride elevator pulley 127 attached to ride elevator cable 107 is shown. The differences in functional capacity between multiple of movable elevator shaft pulley 125 and ride elevator pulley 127 allows for the difference in magnitudes and directions of first velocity 105 and second velocity 103. This can be seen from the independent uses of multiple of movable elevator shaft cable 109 and ride elevator cable 107 resulting in separated motion manipulations of movable elevator shaft 113 and ride elevator 111, respectively.

Figure 5:
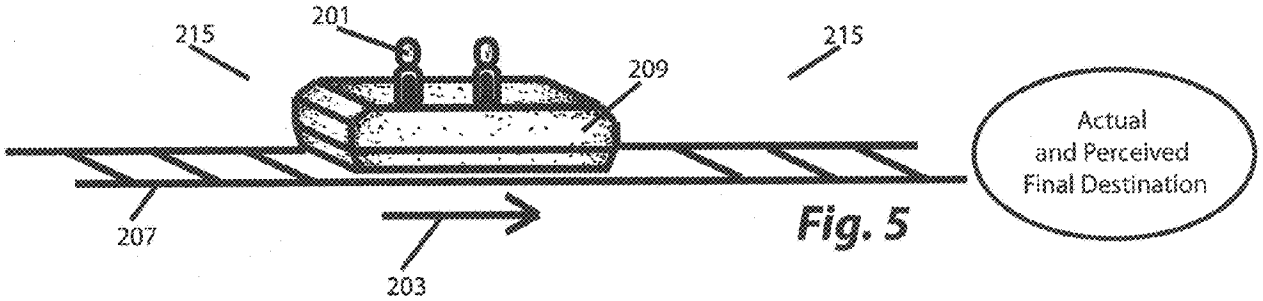
FIG. 5 is a side view of part of a motion ride for creating the illusion of teleportation. A multiple of passengers have a field of vision of a primary environment while moving in a ride car.
Figure 6:
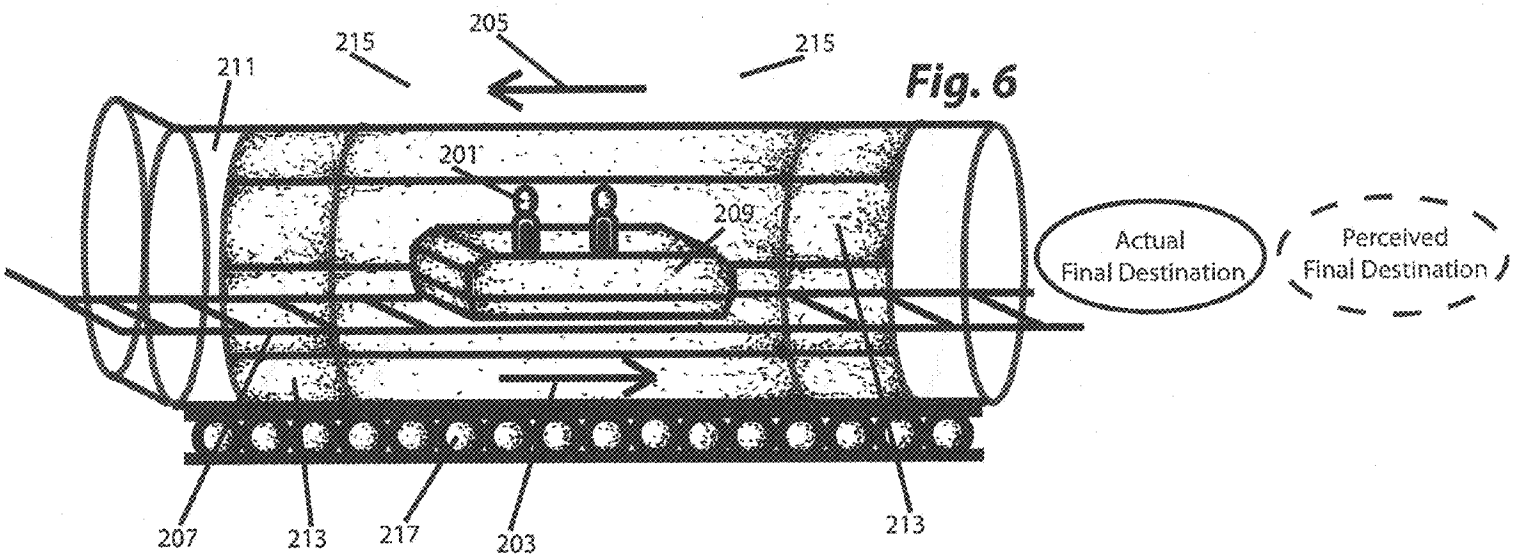
FIG. 6 is a side view in cutaway illustrating a portion of part of a motion ride for creating the illusion of teleportation. A multiple of passengers moving in a ride car have a field of vision of a movable ride tunnel surrounding the ride car. The movable ride tunnel has a first velocity that is of an equal magnitude and the opposite direction relative to a second velocity of the ride car moving along a ride track.
Figure 7:
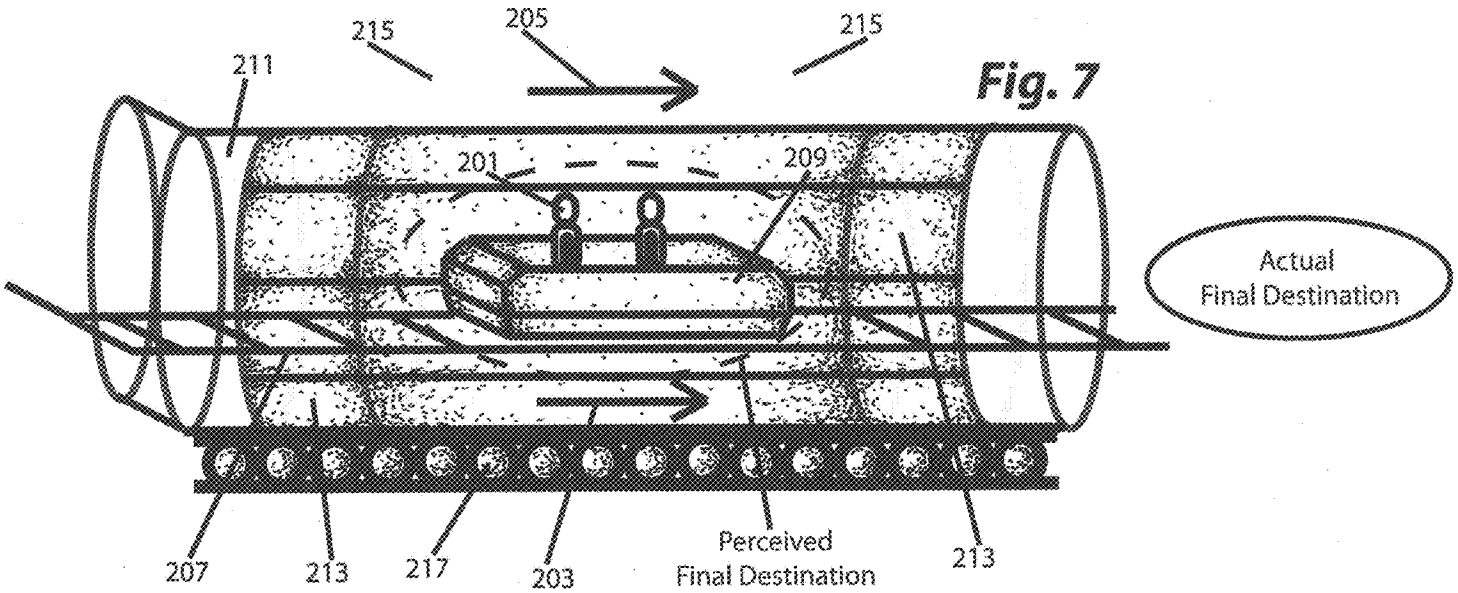
FIG. 7 is a side view in cutaway illustrating a portion of part of a motion ride for creating the illusion of teleportation. A multiple of passengers moving in a ride car have a field of vision of a movable ride tunnel surrounding the ride car. The movable ride tunnel has a first velocity that is of an equal magnitude and the same direction relative to a second velocity of the ride car moving along a ride track.

The second embodiment of the current invention utilizes horizontal motion apparatus along with the four step method of the current invention for creating the illusion of teleportation as presented in FIGS. 5, 6, and 7. The apparatus identified for the second embodiment provides for completing all four steps of the method and technical details are focused only on completing the method of the current invention and not on other widely understood and common motion ride and mechanical transportation practices like the loading and unloading of persons. Furthermore, the front portion of the secondary environment has been cutaway to allow illustration of critical technical details of the apparatus used in the second embodiment as presented in FIGS. 6 and 7. Otherwise, during operation of the motion ride the front portion of the curved wall of the secondary environment will completely surround the passenger vehicle during relative illusion of motion.

In FIG. 5, a side view of part of a motion ride for creating the illusion of teleportation for a second embodiment of the current invention shows multiple of a passenger 201 with field of vision of a primary environment 215 and moving in a passenger vehicle of a ride car 209 that has a second velocity 203. Multiple of passenger 201 has an actual final destination and a perceived final destination that are in the same location as there is no relative illusion of motion experienced. This is a common ride experience as a ride car track 207 guides ride car 209 in a horizontal motion. This would be the state of motion for an entire ride that experiences no relative illusion of motion. This is, however, the state of motion of multiple of passenger 201 in first step of the method 401 (FIG. 16) and fourth step of the method 407 (FIG. 16). This is also the process for completing second step of the method 403 (FIG. 16) as ride car 209 moves multiple of passenger 201 into a movable ride tunnel 211 (FIGS. 6 and 7).

In FIG. 6, a side view in cutaway illustrating a portion of part of a motion ride for creating the illusion of teleportation for the second embodiment of the current invention shows multiple of passenger 201 with field of vision of secondary environment of movable ride tunnel 211 surrounding passenger vehicle of ride car 209. Ride car 209 is carrying multiple of passenger 201 over ride car track 207. Movable ride tunnel 211 is moved by a ride tunnel conveyor belt 217. Movable ride tunnel 211 presents multiple images of motion of secondary environment of movable ride tunnel 211 with a first velocity 205 that is of an equal magnitude and in an opposite direction relative to a second velocity 203 of ride car 209. Movable ride tunnel 211 presents multiple images of motion of secondary environment of movable ride tunnel 211 by multiple of a movable ride tunnel display panel 213. Multiple of movable ride tunnel display panel 213 is multiple of plasma display panel for the second embodiment though other similar display panel types can be utilized (i.e. optical projectors, light-emitting diodes, and liquid crystal displays). This is a unique ride experience as multiple of passenger 201 experiences a relative illusion of motion that creates separated locations of the actual final destination and perceived final destination of ride car 209. The effect of this relative illusion of motion results in multiple of passenger 201 anticipating a perceived final destination of ride car 209 that is a longer distance than the distance of the actual final destination of ride car 209. FIG. 6 represents a first operation of the second embodiment of the motion ride apparatus based upon velocities of movable ride tunnel 211 and ride car 209.

The distance between actual final destination and perceived final destination can be relatively short or long depending on the magnitudes of first velocity 205 and second velocity 203 and depending on durations of motion of ride car 209 and movable ride tunnel 211 during relative illusion of motion. This is the state of motion of multiple of passenger 201 in third step of the method 405 (FIG. 16). The full effect is accomplished after this relative illusion of motion by presenting primary environment 215 in field of vision of multiple of passenger 201 showing the actual final destination of ride car 209 and therefore completing the illusion of teleportation as occurring from perceived final destination to actual final destination.

In FIG. 7, a side view in cutaway illustrating a portion of part of a motion ride for creating the illusion of teleportation for the second embodiment of the current invention shows multiple of passenger 201 with field of vision of secondary environment of movable ride tunnel 211 surrounding passenger vehicle of ride car 209. Ride car 209 is carrying multiple of passenger 201 over ride car track 207. Movable ride tunnel 211 is moved by ride tunnel conveyor belt 217. Movable ride tunnel 211 presents multiple images of motion of secondary environment of movable ride tunnel 211 with a first velocity 205 that is of an equal magnitude and in a same direction relative to second velocity 203 of ride car 209. Movable ride tunnel 211 presents multiple images of motion of secondary environment of movable ride tunnel 211 by multiple of a movable ride tunnel display panel 213. Multiple of movable ride tunnel display panel 213 is multiple of plasma display panel for the second embodiment though other similar display panel types can be utilized (i.e. optical projectors, light-emitting diodes, and liquid crystal displays). This is a unique ride experience as multiple of passenger 201 experiences a relative illusion of motion that creates separated locations of actual final destination and perceived final destination of ride car 209. The effect of this relative illusion of motion results in multiple of passenger 201 anticipating a perceived final destination of ride car 209 that is a shorter distance than the distance of the actual final destination of ride car 209. In fact, multiple of passenger 201 anticipates no displacement of ride car 209 during motion of both ride car 209 and movable ride tunnel 211 during relative illusion of motion. FIG. 7 represents a second operation of the second embodiment of the motion ride apparatus based upon velocities of movable ride tunnel 211 and ride car 209.

The distance between actual final destination and perceived final destination can be relatively short or long depending on the magnitudes of first velocity 205 and second velocity 203 and depending on durations of motion of ride car 209 and movable ride tunnel 211 during relative illusion of motion. This is the state of motion of multiple of passenger 201 in third step of the method 405 (FIG. 16). The full effect is accomplished after this relative illusion of motion by presenting primary environment 215 in field of vision of multiple of passenger 201 showing the actual final destination of ride car 209 and therefore completing the illusion of teleportation as occurring from perceived final destination to actual final destination.

The third embodiment of the current invention utilizes horizontal and vertical motion apparatus along with the four step method of the current invention for creating the illusion of teleportation in a themed amusement motion ride as presented in FIGS. 8, 9, 10, 11, 12, 13, 14, 15*a*, and 15*b*. The apparatus identified for the third embodiment provides for completing all four steps of the method and technical details are focused only on completing the method of the current invention and not on other widely understood and common motion ride and mechanical transportation practices like the loading and unloading of persons. It is noted that the velocities referred to in the listing of elements for the third embodiment identify velocities during relative illusion of motion and further identify vertical velocities and do not correlate to any rotational motion or horizontal motion of the passenger vehicle. Rotational motion and horizontal motion of the third embodiment of the current invention are subjectively used for the theme of the ride for transporting the passenger vehicle through the motion ride and into and out of an elevator structure. Furthermore, portions of the motion ride have been cutaway to allow illustration of critical technical details of the apparatus used in the third embodiment as presented in FIGS. 8, 9, 10, 11, 12, and 13 (front portions) and FIGS. 14, 15*a*, and 15*b* (top portions). Otherwise, front and top portions of the motion ride are present during normal operation of the motion ride.

Figure 8:
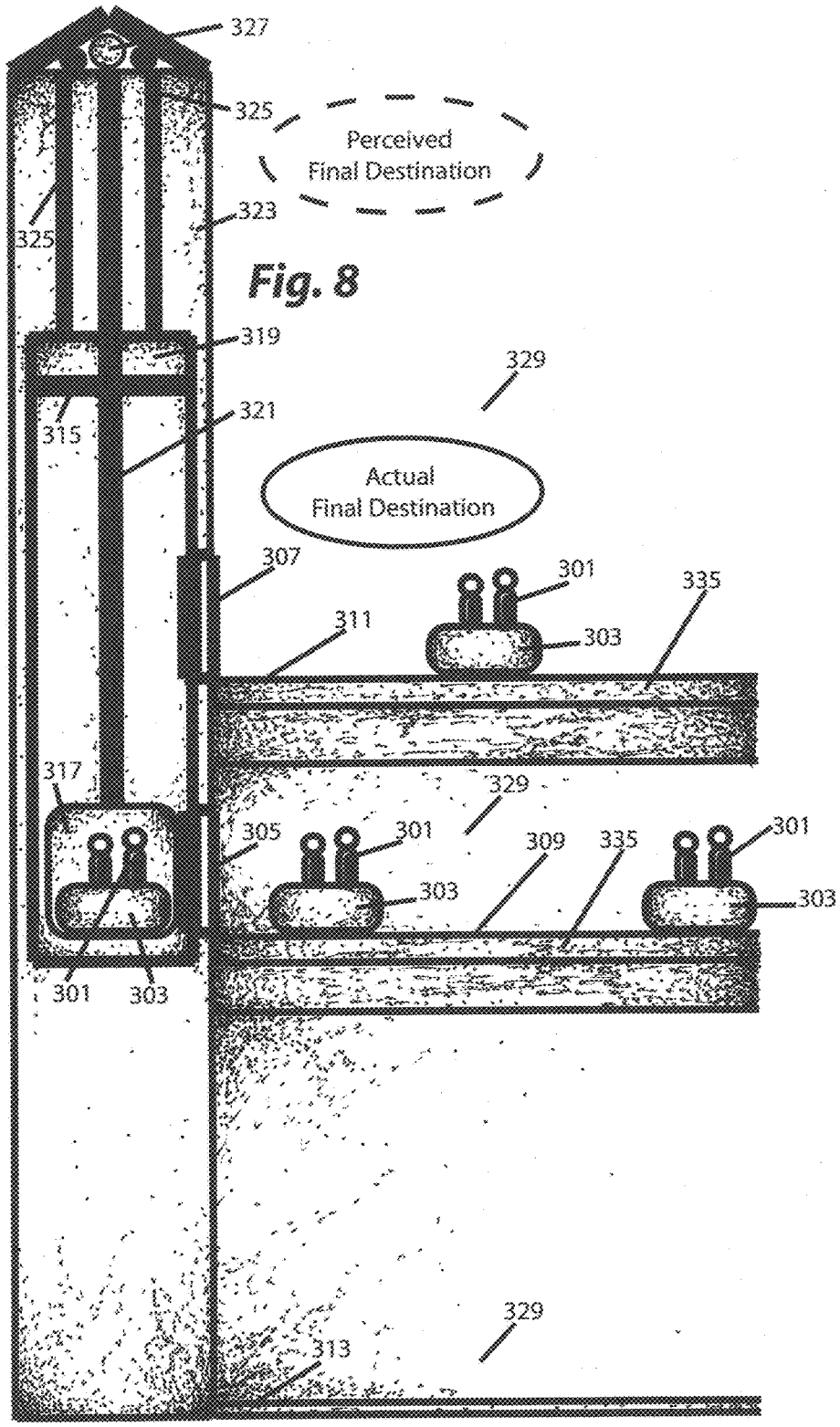
FIG. 8 is a front view in cutaway illustrating a portion of part of multiple floor levels and tower of a motion ride for creating the illusion of teleportation. Multiple passengers in multiple variably magnetized automated guided vehicles are traveling along a variably magnetized ride track and into and out of a variably magnetized ride elevator that is surrounded by a movable elevator shaft. A single variably magnetized automated guided vehicle in the variably magnetized ride elevator is in the start of a third step of four steps of a method for creating the illusion of teleportation.

In FIG. 8, a front view in cutaway illustrating a portion of part of a motion ride for creating the illusion of teleportation for a third embodiment of the current invention is shown. Multiple of a passenger 301 in multiple of a passenger vehicle of a variably magnetized automated guided vehicle 303 is traveling along a variably magnetized ride track 335 on multiple floor levels including a middle floor 309 and an upper floor 311 and into and out of a variably magnetized ride elevator 317 surrounded by a secondary environment of a movable elevator shaft 319. Variably magnetized automated guided vehicle 303 is in the start of third step of the method 405 (FIG. 16) where variably magnetized automated guided vehicle 303 has entered variably magnetized ride elevator 317 through an elevator entrance 305. Variably magnetized automated guided vehicle 303 inside of variably magnetized ride elevator 317 is surrounded by movable elevator shaft 319. This results in a primary environment 329 not being in field of vision of multiple of passenger 301 of variably magnetized automated guided vehicle 303 in variably magnetized ride elevator 317. FIG. 8 represents a first operation of the third embodiment of the motion ride apparatus based upon velocities of movable elevator shaft 319 and variably magnetized automated guided vehicle 303.

Multiple of variably magnetized automated guided vehicle 303 on middle floor 309 and upper floor 311 is carrying multiple of passenger 301 with field of vision of primary environment 329 as multiple of variably magnetized automated guided vehicle is outside of movable elevator shaft 319. Multiple of variably magnetized automated guided vehicle 303 on middle floor 309 is in first step of the method 401 (FIG. 16) and multiple of variably magnetized automated guided vehicle 303 on upper floor 311 is in fourth step of the method 407 (FIG. 16). A tower 323 is housing a cables and pulley system 327 with a movable elevator shaft cable 325 attached to and moving movable elevator shaft 319 and a ride elevator cable 321 attached to and moving variably magnetized ride elevator 317. A movable elevator shaft platform 315 is inside movable elevator shaft 319 and found above variably magnetized ride elevator 317. An elevator exit 307 is found on upper floor 311 where multiple of variably magnetized automated guided vehicle 303 is leaving movable elevator shaft 319. A lower floor 313 is the lowest of multiple levels of the motion ride.

The effect of this motion ride is multiple of passenger 301 anticipating a perceived final destination that is of a higher floor level than the actual final destination of variably magnetized automated guided vehicle 303. The distance between actual final destination and perceived final destination can be relatively short or long depending on the magnitudes of first velocity 331 and second velocity 333 and depending on durations of motion of variably magnetized automated guided vehicle 303 and movable elevator shaft 319 during relative illusion of motion. The full effect is accomplished after this relative illusion of motion by presenting primary environment 329 in field of vision of multiple of passenger 301 showing the actual final destination of variably magnetized automated guided vehicle 303 and therefore completing the illusion of teleportation from perceived final destination to actual final destination.

Figure 9:
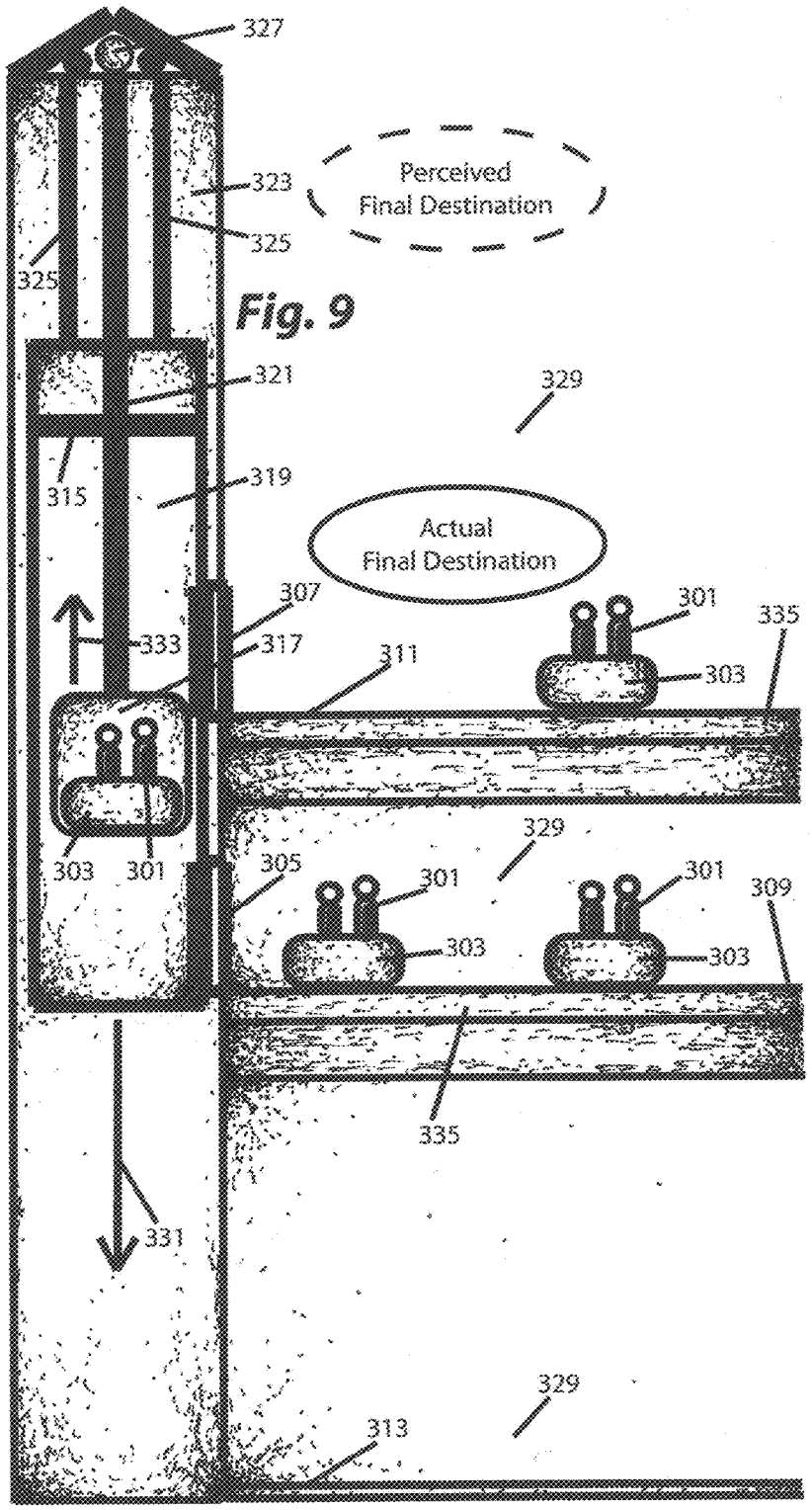
FIG. 9 is a front view in cutaway illustrating a portion of part of multiple floor levels and tower of a motion ride for creating the illusion of teleportation. Multiple passengers in multiple variably magnetized automated guided vehicles are traveling along a variably magnetized ride track and into and out of a variably magnetized ride elevator that is surrounded by a movable elevator shaft. A single variably magnetized automated guided vehicle in the variably magnetized ride elevator is in the middle of a third step of four steps of a method for creating the illusion of teleportation with a first velocity of the movable elevator shaft that is a greater magnitude and the opposite direction relative to a second velocity of the variably magnetized ride elevator and variably magnetized automated guided vehicle.

In FIG. 9, a front view in cutaway illustrating a portion of part of a motion ride for creating the illusion of teleportation for the third embodiment of the current invention is shown. Multiple of passenger 301 in multiple of passenger vehicle of variably magnetized automated guided vehicle 303 is traveling along variably magnetized ride track 335 on multiple floor levels including middle floor 309 and upper floor 311 and into and out of variably magnetized ride elevator 317 surrounded by secondary environment of movable elevator shaft 319. Variably magnetized automated guided vehicle 303 is in the middle of third step of the method 405 (FIG. 16) where variably magnetized automated guided vehicle 303 is in variably magnetized ride elevator 317 with variably magnetized automated guided vehicle 303 moving at second velocity 333 and movable elevator shaft 319 moving at first velocity 331. First velocity 331 is identified relative to second velocity 333 as being greater in magnitude and in the opposite direction. Variably magnetized automated guided vehicle 303 inside of variably magnetized ride elevator 317 is surrounded by movable elevator shaft 319. This results in primary environment 329 not being in field of vision of multiple of passenger 301 of variably magnetized automated guided vehicle 303 in variably magnetized ride elevator 317. FIG. 9 represents a first operation of the third embodiment of the motion ride apparatus based upon velocities of movable elevator shaft 319 and variably magnetized automated guided vehicle 303.

Multiple of variably magnetized automated guided vehicle 303 on middle floor 309 and upper floor 311 is carrying multiple of passenger 301 with field of vision of primary environment 329 as multiple of variably magnetized automated guided vehicle is outside of movable elevator shaft 319. Multiple of variably magnetized automated guided vehicle 303 on middle floor 309 is in first step of the method 401 (FIG. 16) and multiple of variably magnetized automated guided vehicle 303 on upper floor 311 is in fourth step of the method 407 (FIG. 16). Tower 323 is housing a cables and pulley system 327 with movable elevator shaft cable 325 attached to and moving movable elevator shaft 319 and ride elevator cable 321 attached to and moving variably magnetized ride elevator 317. Movable elevator shaft platform 315 is inside movable elevator shaft 319 and found above variably magnetized ride elevator 317. Elevator exit 307 is found on upper floor 311 where multiple of variably magnetized automated guided vehicle 303 is leaving movable elevator shaft 319. Lower floor 313 is the lowest of multiple levels of the motion ride.

The effect of this motion ride is multiple of passenger 301 anticipating a perceived final destination that is of a higher floor level than the actual final destination of variably magnetized automated guided vehicle 303. The distance between actual final destination and perceived final destination can be relatively short or long depending on the magnitudes of first velocity 331 and second velocity 333 and depending on durations of motion of variably magnetized automated guided vehicle 303 and movable elevator shaft 319 during relative illusion of motion. The full effect is accomplished after this relative illusion of motion by presenting primary environment 329 in field of vision of multiple of passenger 301 showing the actual final destination of variably magnetized automated guided vehicle 303 and therefore completing the illusion of teleportation from perceived final destination to actual final destination.

Figure 10:
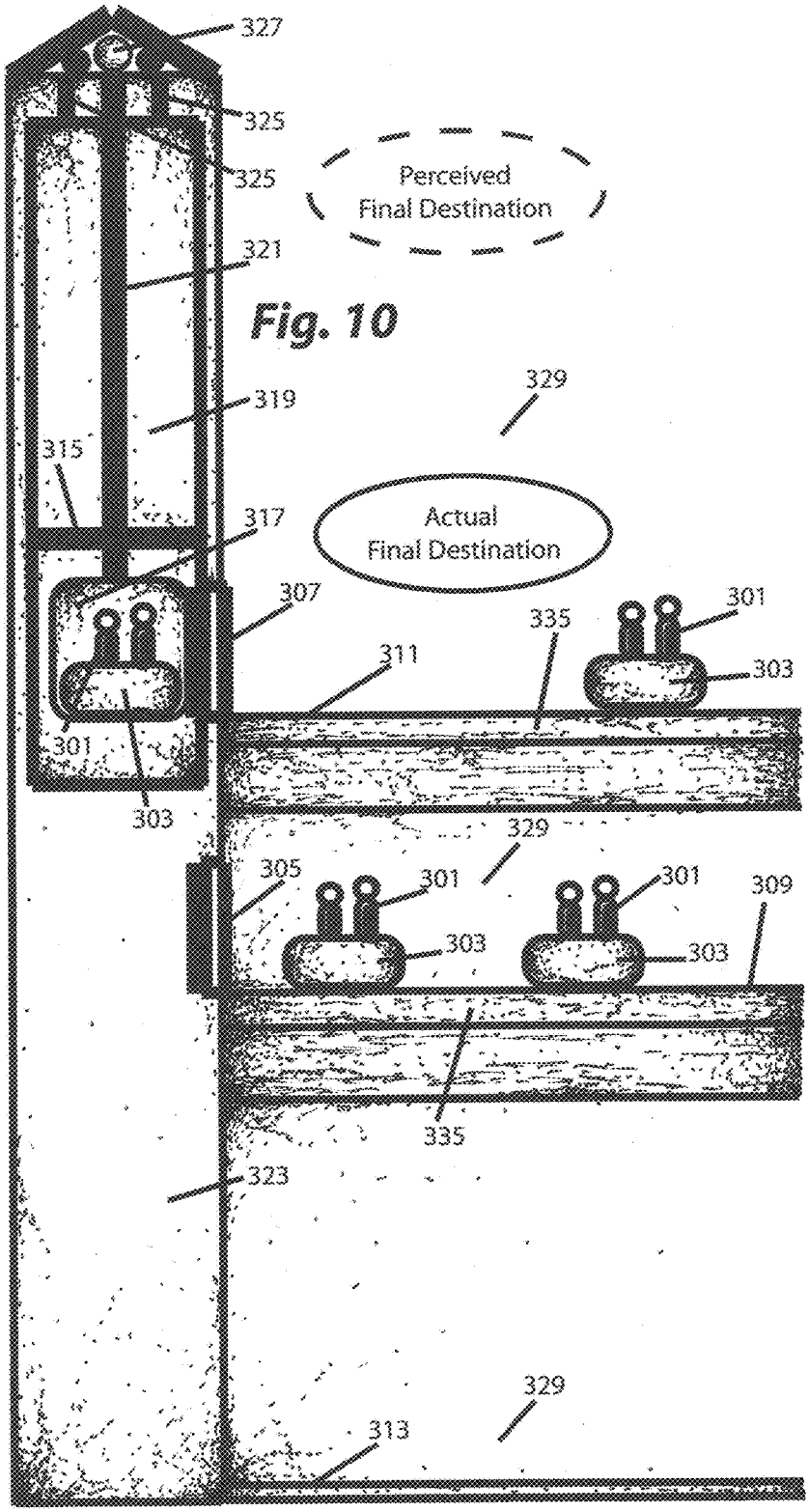
FIG. 10 is a front view in cutaway illustrating a portion of part of multiple floor levels and tower of a motion ride for creating the illusion of teleportation. Multiple passengers in multiple variably magnetized automated guided vehicles are traveling along a variably magnetized ride track and into and out of a variably magnetized ride elevator that is surrounded by a movable elevator shaft. A single variably magnetized automated guided vehicle in the variably magnetized ride elevator is in the end of a third step of four steps of a method for creating the illusion of teleportation.

In FIG. 10, a front view in cutaway illustrating a portion of part of a motion ride for creating the illusion of teleportation for the third embodiment of the current invention is shown. Multiple of passenger 301 in multiple of passenger vehicle of variably magnetized automated guided vehicle 303 is traveling along variably magnetized ride track 335 on multiple floor levels including middle floor 309 and upper floor 311 and into and out of variably magnetized ride elevator 317 surrounded by secondary environment of movable elevator shaft 319. Variably magnetized automated guided vehicle 303 is in the end of third step of the method 405 (FIG. 16) where variably magnetized automated guided vehicle 303 is exiting variably magnetized ride elevator 317 through elevator exit 307. Variably magnetized automated guided vehicle 303 inside of variably magnetized ride elevator 317 is surrounded by movable elevator shaft 319. This results in primary environment 329 not being in field of vision of multiple of passenger 301 of variably magnetized automated guided vehicle 303 in variably magnetized ride elevator 317. FIG. 10 represents a first operation of the third embodiment of the motion ride apparatus based upon velocities of movable elevator shaft 319 and variably magnetized automated guided vehicle 303.

Multiple of variably magnetized automated guided vehicle 303 on middle floor 309 and upper floor 311 is carrying multiple of passenger 301 with field of vision of primary environment 329 as multiple of variably magnetized automated guided vehicle is outside of movable elevator shaft 319. Multiple of variably magnetized automated guided vehicle 303 on middle floor 309 is in first step of the method 401 (FIG. 16) and multiple of variably magnetized automated guided vehicle 303 on upper floor 311 is in fourth step of the method 407 (FIG. 16). Tower 323 is housing cables and pulley system 327 with movable elevator shaft cable 325 attached to and moving movable elevator shaft 319 and ride elevator cable 321 attached to and moving variably magnetized ride elevator 317. Movable elevator shaft platform 315 is inside movable elevator shaft 319 and found above variably magnetized ride elevator 317. Lower floor 313 is the lowest of multiple levels of the motion ride.

The effect of this motion ride is multiple of passenger 301 anticipating a perceived final destination that is of a higher floor level than the actual final destination of variably magnetized automated guided vehicle 303. The distance between actual final destination and perceived final destination can be relatively short or long depending on the magnitudes of first velocity 331 and second velocity 333 and depending on durations of motion of variably magnetized automated guided vehicle 303 and movable elevator shaft 319 during relative illusion of motion. The full effect is accomplished after this relative illusion of motion by presenting primary environment 329 in field of vision of multiple of passenger 301 showing the actual final destination of variably magnetized automated guided vehicle 303 and therefore completing the illusion of teleportation from perceived final destination to actual final destination.

Figure 11:
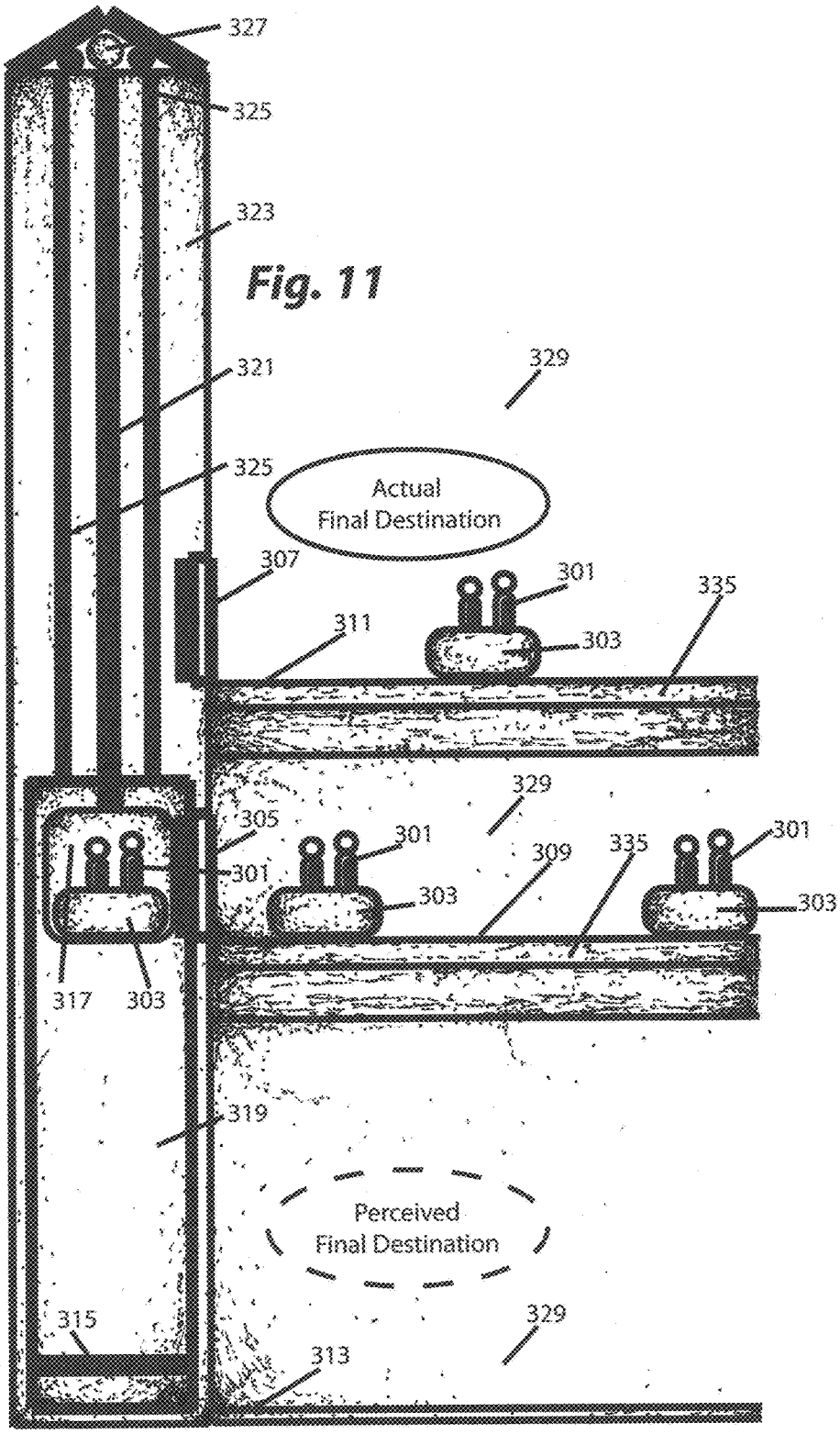
FIG. 11 is a front view in cutaway illustrating a portion of part of multiple floor levels and tower of a motion ride for creating the illusion of teleportation. Multiple passengers in multiple variably magnetized automated guided vehicles are traveling along a variably magnetized ride track and into and out of a variably magnetized ride elevator that is surrounded by a movable elevator shaft. A single variably magnetized automated guided vehicle in the variably magnetized ride elevator is in the start of a third step of four steps of a method for creating the illusion of teleportation.

In FIG. 11, a front view in cutaway illustrating a portion of part of a motion ride for creating the illusion of teleportation for the third embodiment of the current invention is shown. Multiple of passenger 301 in multiple of passenger vehicle of variably magnetized automated guided vehicle 303 travels along variably magnetized ride track 335 on multiple floor levels including middle floor 309 and upper floor 311 and into and out of variably magnetized ride elevator 317 surrounded by secondary environment of movable elevator shaft 319. Variably magnetized automated guided vehicle 303 is in the start of third step of the method 405 (FIG. 16) where variably magnetized automated guided vehicle 303 has entered variably magnetized ride elevator 317 through elevator entrance 305. Variably magnetized automated guided vehicle 303 inside of variably magnetized ride elevator 317 is surrounded by movable elevator shaft 319. This results in primary environment 329 not being in field of vision of multiple of passenger 301 of variably magnetized automated guided vehicle 303 in variably magnetized ride elevator 317. FIG. 11 represents a second operation of the third embodiment of the motion ride apparatus based upon velocities of movable elevator shaft 319 and variably magnetized automated guided vehicle 303.

Multiple of variably magnetized automated guided vehicle 303 on middle floor 309 and upper floor 311 is carrying multiple of passenger 301 with field of vision of primary environment 329 as multiple of variably magnetized automated guided vehicle is outside of movable elevator shaft 319. Multiple of variably magnetized automated guided vehicle 303 on middle floor 309 is in first step of the method 401 (FIG. 16) and multiple of variably magnetized automated guided vehicle 303 on upper floor 311 is in fourth step of the method 407 (FIG. 16). Tower 323 is housing cables and pulley system 327 with movable elevator shaft cable 325 attached to and moving movable elevator shaft 319 and ride elevator cable 321 attached to and moving variably magnetized ride elevator 317. Movable elevator shaft platform 315 is inside movable elevator shaft 319 and found below variably magnetized ride elevator 317. Elevator exit 307 is found on upper floor 311 where multiple of variably magnetized automated guided vehicle 303 is leaving movable elevator shaft 319. Lower floor 313 is the lowest of multiple levels of the motion ride.

The effect of this motion ride is multiple of passenger 301 anticipating a perceived final destination that is of a lower floor level than the actual final destination of variably magnetized automated guided vehicle 303. The distance between actual final destination and perceived final destination can be relatively short or long depending on the magnitudes of first velocity 331 and second velocity 333 and depending on durations of motion of variably magnetized automated guided vehicle 303 and movable elevator shaft 319 during relative illusion of motion. The full effect is accomplished after this relative illusion of motion by presenting primary environment 329 in field of vision of multiple of passenger 301 showing the actual final destination of variably magnetized automated guided vehicle 303 and therefore completing the illusion of teleportation from perceived final destination to actual final destination.

Figure 12:
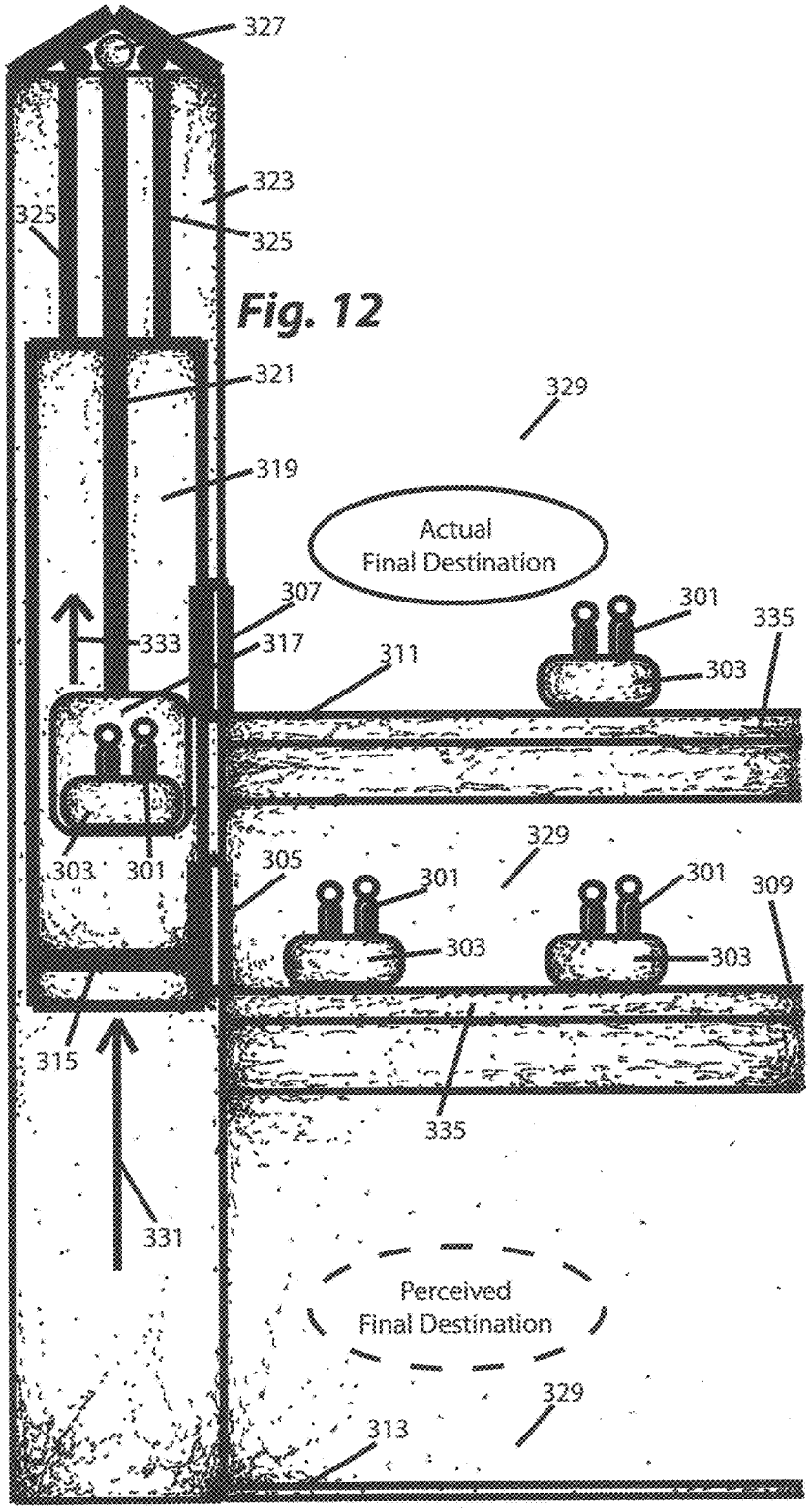
FIG. 12 is a front view in cutaway illustrating a portion of part of multiple floor levels and tower of a motion ride for creating the illusion of teleportation. Multiple passengers in multiple variably magnetized automated guided vehicles are traveling along a variably magnetized ride track and into and out of a variably magnetized ride elevator that is surrounded by a movable elevator shaft. A single variably magnetized automated guided vehicle in the variably magnetized ride elevator is in the middle of a third step of four steps of a method for creating the illusion of teleportation with a first velocity of the movable elevator shaft that is a greater magnitude and the same direction relative to a second velocity of the variably magnetized ride elevator and variably magnetized automated guided vehicle.

In FIG. 12, a front view in cutaway illustrating a portion of part of a motion ride for creating the illusion of teleportation for the third embodiment of the current invention is shown. Multiple of passenger 301 in a multiple of passenger vehicle of variably magnetized automated guided vehicle 303 travels along variably magnetized ride track 335 on multiple floor levels including middle floor 309 and upper floor 311 and into and out of variably magnetized ride elevator 317 surrounded by secondary environment of movable elevator shaft 319. Variably magnetized automated guided vehicle 303 is in the middle of third step of the method 405 (FIG. 16) where variably magnetized automated guided vehicle 303 is in variably magnetized ride elevator 317 with variably magnetized automated guided vehicle 303 moving at second velocity 333 and movable elevator shaft 319 moving at first velocity 331. First velocity 331 is identified relative to second velocity 333 as being greater in magnitude and in the same direction. Variably magnetized automated guided vehicle 303 inside of variably magnetized ride elevator 317 is surrounded by movable elevator shaft 319. This results in primary environment 329 not being in field of vision of multiple of passenger 301 of variably magnetized automated guided vehicle 303 in variably magnetized ride elevator 317. FIG. 12 represents a second operation of the third embodiment of the motion ride apparatus based upon velocities of movable elevator shaft 319 and variably magnetized automated guided vehicle 303.

Multiple of variably magnetized automated guided vehicle 303 on middle floor 309 and upper floor 311 is carrying multiple of passenger 301 with field of vision of primary environment 329 as multiple of variably magnetized automated guided vehicle is outside of movable elevator shaft 319. Multiple of variably magnetized automated guided vehicle 303 on middle floor 309 is in first step of the method 401 (FIG. 16) and multiple of variably magnetized automated guided vehicle 303 on upper floor 311 is in fourth step of the method 407 (FIG. 16). Tower 323 is housing cables and pulley system 327 with movable elevator shaft cable 325 attached to and moving movable elevator shaft 319 and ride elevator cable 321 attached to and moving variably magnetized ride elevator 317. Movable elevator shaft platform 315 is inside movable elevator shaft 319 and found below variably magnetized ride elevator 317. Elevator exit 307 is found on upper floor 311 where multiple of variably magnetized automated guided vehicle 303 is leaving movable elevator shaft 319. Lower floor 313 is the lowest of multiple levels of the motion ride.

The effect of this motion ride is multiple of passenger 301 anticipating a perceived final destination that is of a lower floor level than the actual final destination of variably magnetized automated guided vehicle 303. The distance between actual final destination and perceived final destination can be relatively short or long depending on the magnitudes of first velocity 331 and second velocity 333 and depending on durations of motion of variably magnetized automated guided vehicle 303 and movable elevator shaft 319 during relative illusion of motion. The full effect is accomplished after this relative illusion of motion by presenting primary environment 329 in field of vision of multiple of passenger 301 showing the actual final destination of variably magnetized automated guided vehicle 303 and therefore completing the illusion of teleportation from perceived final destination to actual final destination.

Figure 13:
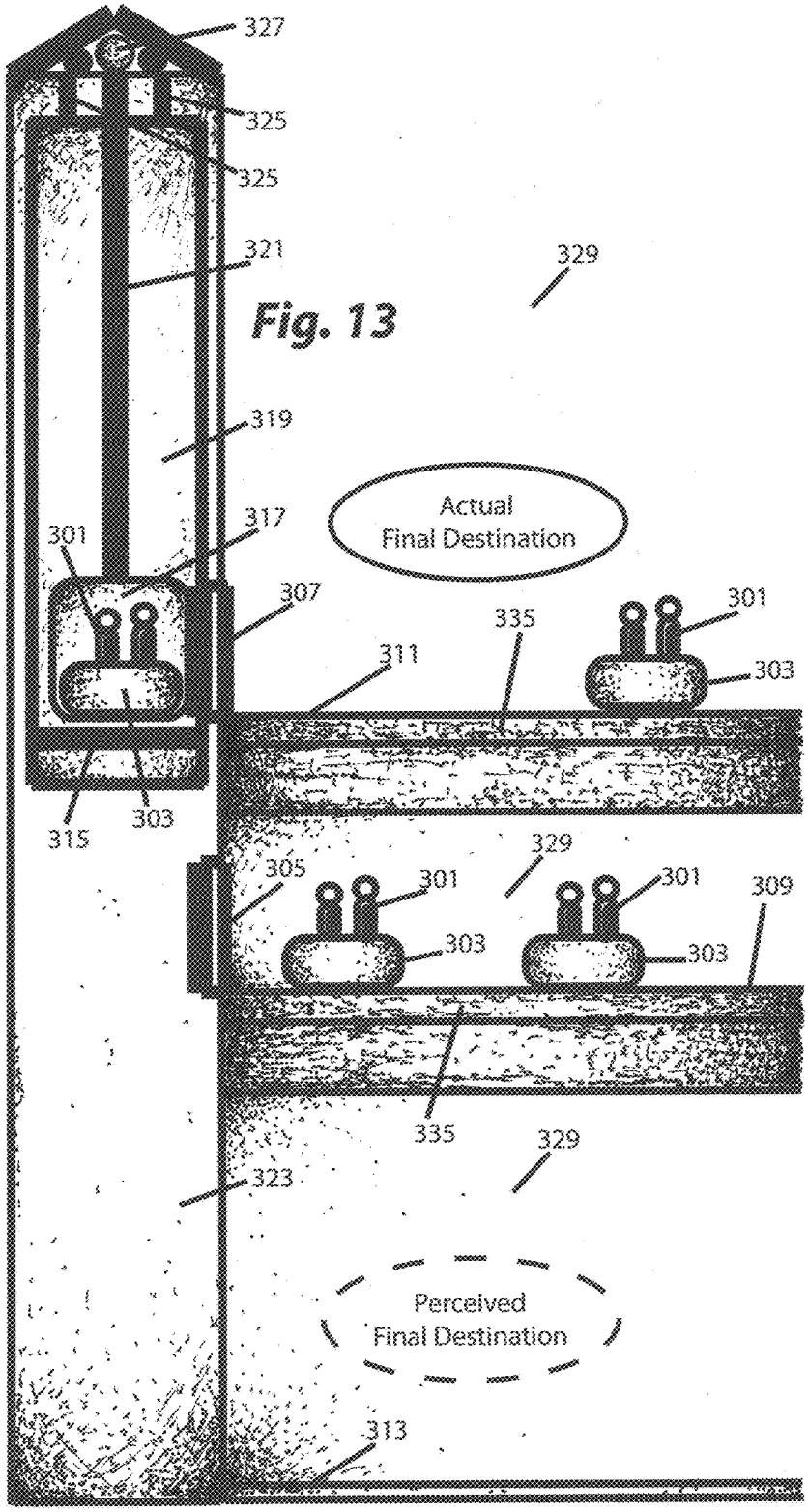
FIG. 13 is a front view in cutaway illustrating a portion of part of multiple floor levels and tower of a motion ride for creating the illusion of teleportation. Multiple passengers in multiple variably magnetized automated guided vehicles are traveling along a variably magnetized ride track and into and out of a ride elevator that is surrounded by a movable elevator shaft. A single variably magnetized automated guided vehicle in the variably magnetized ride elevator is in the end of a third step of four steps of a method for the illusion of teleportation.

In FIG. 13, a front view in cutaway illustrating a portion of part of a motion ride for creating the illusion of teleportation for the third embodiment of the current invention is shown. Multiple of passenger 301 in multiple of passenger vehicle of variably magnetized automated guided vehicle 303 is traveling along variably magnetized ride track 335 on multiple floor levels including middle floor 309 and upper floor 311 and into and out of variably magnetized ride elevator 317 surrounded by secondary environment of movable elevator shaft 319. Variably magnetized automated guided vehicle 303 is in the end of third step of the method 405 (FIG. 16) where variably magnetized automated guided vehicle 303 is exiting variably magnetized ride elevator 317 through elevator exit 307. Variably magnetized automated guided vehicle 303 inside of variably magnetized ride elevator 317 is surrounded by movable elevator shaft 319. This results in primary environment 329 not being in field of vision of multiple of passenger 301 of variably magnetized automated guided vehicle 303 in variably magnetized ride elevator 317. FIG. 13 represents a second operation of the third embodiment of the motion ride apparatus based upon velocities of movable elevator shaft 319 and variably magnetized automated guided vehicle 303.

Multiple of variably magnetized automated guided vehicle 303 on middle floor 309 and upper floor 311 is carrying multiple of passenger 301 with field of vision of primary environment 329 as multiple of variably magnetized automated guided vehicle is outside of movable elevator shaft 319. Multiple of variably magnetized automated guided vehicle 303 on middle floor 309 is in first step of the method 401 (FIG. 16) and multiple of variably magnetized automated guided vehicle 303 on upper floor 311 is in fourth step of the method 407 (FIG. 16). Tower 323 is housing cables and pulley system 327 with movable elevator shaft cable 325 attached to and moving movable elevator shaft 319 and ride elevator cable 321 attached to and moving variably magnetized ride elevator 317. Movable elevator shaft platform 315 is inside movable elevator shaft 319 and found below variably magnetized ride elevator 317. Lower floor 313 is the lowest of multiple levels of the motion ride.

The effect of this motion ride is multiple of passenger 301 anticipating a perceived final destination that is of a lower floor level than the actual final destination of variably magnetized automated guided vehicle 303. The distance between actual final destination and perceived final destination can be relatively short or long depending on the magnitudes of first velocity 331 and second velocity 333 and depending on durations of motion of variably magnetized automated guided vehicle 303 and movable elevator shaft 319 during relative illusion of motion. The full effect is accomplished after this relative illusion of motion by presenting primary environment 329 in field of vision of multiple of passenger 301 showing the actual final destination of variably magnetized automated guided vehicle 303 and therefore completing the illusion of teleportation from perceived final destination to actual final destination.

In FIG. 14, an aerial view in cutaway illustrating a portion of part of a motion ride for creating the illusion of teleportation for the third embodiment of the current invention is shown. Multiple of passenger 301 in passenger vehicle of variably magnetized automated guided vehicle 303 is traveling along a variably magnetized ride track 335 into variably magnetized ride elevator 317 surrounded by secondary environment of movable elevator shaft 319 with variably magnetized ride elevator 317 housing multiple of a variably magnetized ride elevator component 343. Variably magnetized ride track 335 has along each of its sides multiple of a variably magnetized ride track component 339. Variably magnetized automated guided vehicle 303 is housing multiple of a variably magnetized automated guided vehicle component 337. A variably magnetized elevator door 345 is housing multiple of a variably magnetized elevator door component 341. Variably magnetized automated guided vehicle 303 is entering variably magnetized ride elevator 317 with multiple of variably magnetized ride track component 341 and multiple of variably magnetized automated guided vehicle component 337 guiding variably magnetized automated guided vehicle 303 by partial stabilization and propulsion of motion created by variably magnetized automated guided vehicle 303.

This motion represents the start of second step of the method 403 (FIG. 16) as variably magnetized automated guided vehicle 303 is moving out of primary environment 329 and into secondary environment of movable elevator shaft 319. Magnetization forces act on one another to partially stabilize and propel variably magnetized automated guided vehicle 303 as it begins moving into variably magnetized ride elevator 317.

Figure 15A:
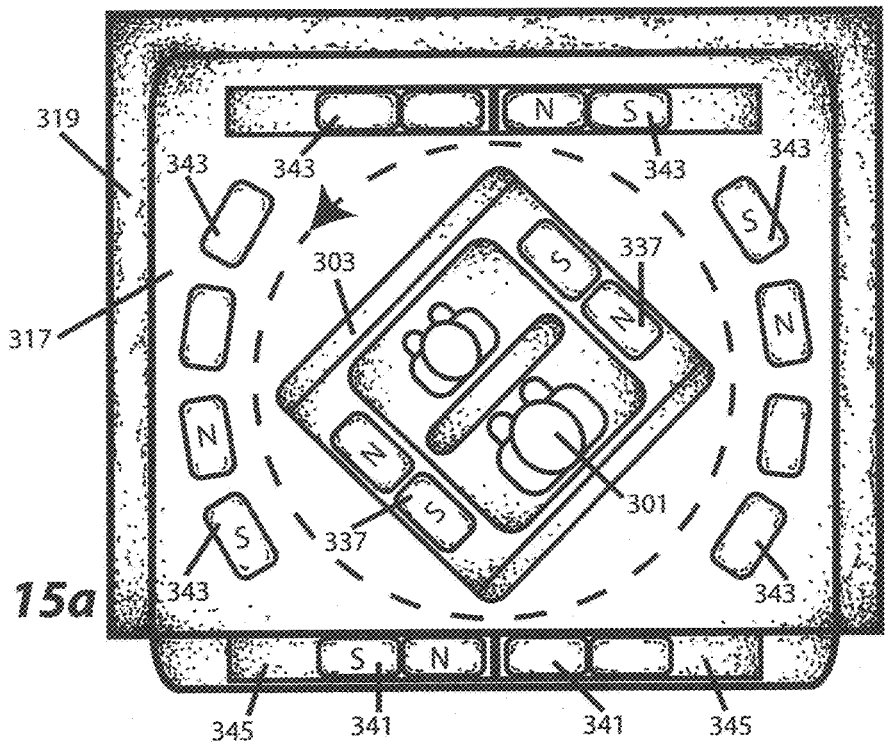
FIG. 15*a* is an aerial view in cutaway illustrating a portion of part of a tower of a motion ride for creating the illusion of teleportation. Multiple passengers in a variably magnetized automated guided vehicle with multiple variably magnetized automated guided vehicle components are moving in a variably magnetized ride elevator surrounded by a movable elevator shaft with the variably magnetized ride elevator housing multiple variably magnetized ride elevator components. The variably magnetized automated guided vehicle is at the beginning of a rotation.

In FIG. 15*a*, an aerial view in cutaway illustrating a portion of a motion ride for creating the illusion of teleportation for the third embodiment of the current invention is shown. Multiple of passenger 301 in passenger vehicle of variably magnetized automated guided vehicle 303 rotates in variably magnetized ride elevator 317 surrounded by secondary environment of movable elevator shaft 319 with variably magnetized ride elevator 317 housing multiple of a variably magnetized elevator component 343. Variably magnetized automated guided vehicle 303 is housing multiple of variably magnetized automated guided vehicle component 337. Variably magnetized elevator door 345 is housing multiple of variably magnetized elevator door component 341. Variably magnetized automated guided vehicle 303 is in the beginning of a rotation in variably magnetized ride elevator 317 by multiple of variably magnetized elevator component 343, multiple of variably magnetized elevator door component 341, and multiple of variably magnetized automated guided vehicle component 337 guiding variably magnetized automated guided vehicle 303 by partial stabilization and propulsion of motion created by variably magnetized automated guided vehicle 303.

This motion represents the middle of second step of the method 403 (FIG. 16) as variably magnetized automated guided vehicle 303 has moved out of primary environment 329 and into secondary environment of movable elevator shaft 319. Magnetization forces act on one another to partially stabilize and propel variably magnetized automated guided vehicle 303 as it begins a rotation in variably magnetized ride elevator 317.

Figure 15B:
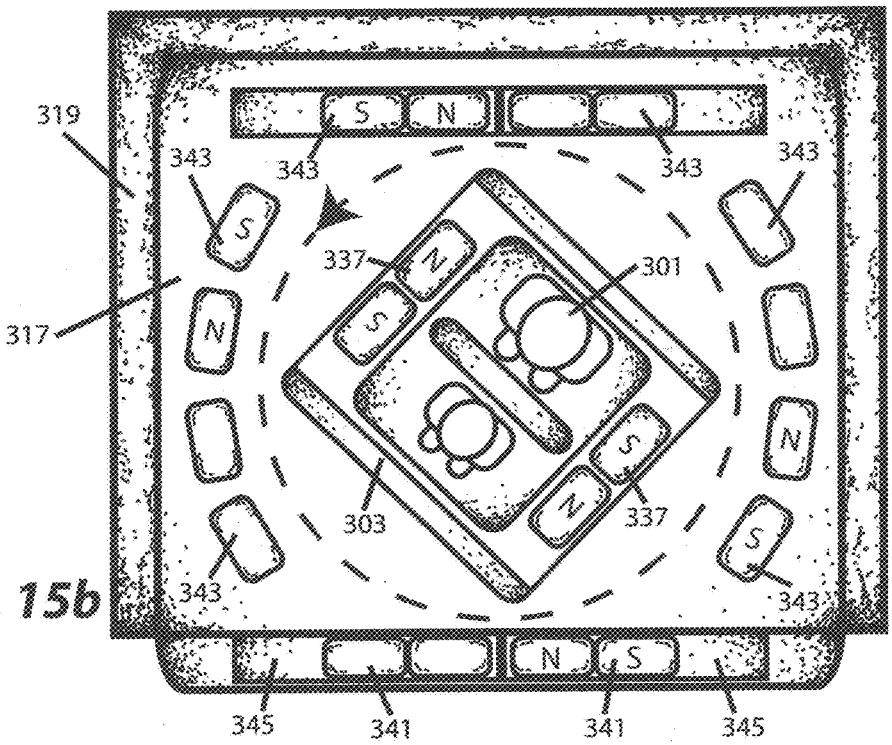
FIG. 15*b* is an aerial view in cutaway illustrating a portion of part of a tower of a motion ride for creating the illusion of teleportation. Multiple passengers in a variably magnetized automated guided vehicle with multiple variably magnetized automated guided vehicle components are moving in a variably magnetized ride elevator surrounded by a movable elevator shaft with the variably magnetized ride elevator housing multiple variably magnetized ride elevator components. The variably magnetized automated guided vehicle is at the end of a rotation.

In FIG. 15*b*, an aerial view in cutaway illustrating a portion of part of a motion ride for creating the illusion of teleportation for the third embodiment of the current invention is shown. Multiple of passenger 301 in passenger vehicle of variably magnetized automated guided vehicle 303 rotates in variably magnetized ride elevator 317 surrounded by secondary environment of movable elevator shaft 319 with variably magnetized ride elevator 317 housing multiple of variably magnetized elevator component 343. Variably magnetized automated guided vehicle 303 is housing multiple of variably magnetized automated guided vehicle component 337. Variably magnetized elevator door 345 is housing multiple of variably magnetized elevator door component 341. Variably magnetized automated guided vehicle 303 is at the ending of a rotation in variably magnetized ride elevator 317 by multiple of variably magnetized elevator component 343, multiple of variably magnetized elevator door component 341, and multiple of variably magnetized automated guided vehicle component 337 guiding variably magnetized automated guided vehicle 303 by partial stabilization and propulsion of motion created by variably magnetized automated guided vehicle 303.

This motion represents the end of second step of the method 403 (FIG. 16) as variably magnetized automated guided vehicle 303 has moved out of primary environment 329 and into secondary environment of movable elevator shaft 319. Magnetization forces act on one another to partially stabilize and propel variably magnetized automated guided vehicle 303 as it ends a rotation in variably magnetized ride elevator 317.

This third embodiment of the current invention uses a ride theme based on Victor Hugo's The Hunchback of Notre-Dame with Notre Dame Cathedral used as a model for the style of structure of the motion ride. Riders of the motion ride are taken through multiple floor levels and into and out of a towering structure. On one side of the motion ride the towering structure is imagined as a fireplace with a vertical chimney and on the other side of the motion ride it is a staircase leading to a bell room. As riders ascend through either themes of towering structure there is relative illusion of motion created.

In a first operation of the ride, as described in FIGS. 8, 9, and 10, relative illusion of motion creates a perceived final destination in the mind of the riders of a higher level of a "South Tower" of the cathedral. The actual final destination is revealed to be a lower level relative to this famous room that holds the great bourdon bell which tolls for the hours of the day. The presentation of the actual final destination is in stark contrast to what riders perceive should be their location following the relative illusion of motion and thus creates the illusion of teleportation. To add to this illusion of teleportation, elements of rushing air, light, and sound above the riders create chilling and rushing cold air, light akin to skylight, and sounds of bells tolling. A voice identified as "Quasimodo", a main character of a hunchback from The Hunchback of Notre-Dame, is produced above the riders as a vocal narration casting a gothic spell on those breaking forbidden trespassing so as to send them "instantly" away from the bell tower. This narration occurs directly before the presenting of the actual final destination to riders.

In a second operation of the ride, as described in FIGS. 11, 12, and 13, relative illusion of motion creates a perceived final destination in the mind of the riders of a lower level of "Hell."

The actual final destination is revealed to be a higher level above ground where riders are presented a view on top of the cathedral of the ground level, being the street, several floors below them. The presentation of the actual final destination is in stark contrast to what riders perceive should be their location following the relative illusion of motion and thus creates the illusion of teleportation. To add to this illusion of teleportation, elements of rushing air, light, and sound effects below the riders create heat from rushing hot air, light akin to a fire, and the sound of crackling of burning wood. A voice identified as "Esmeralda", a main character of a gypsy from The Hunchback of Notre-Dame, is produced below the riders as a vocal narration casting a gypsy-enchanting spell of teleportation to "instantly" send riders safely out of "Hell." This occurs directly before the presenting of the actual final destination to riders.

The subjective themes and stories to accompany this unique effect of creating the illusion of teleportation on a multiple of riders in a motion ride are limitless and the personal choice of The Hunchback of Notre-Dame theme is only one example among thousands of historical and well-appreciated fictional stories of adventure.

In FIG. 16, a flowchart of four steps of the method of the current invention for creating the illusion of teleportation by temporal execution of first step of the method 401, second step of the method 403, third step of the method 405, and fourth step of the method 407 of the current invention is shown. The method along with apparatus as described in the three embodiments of the current invention is a unique technology for effectively creating the illusion of teleportation on multiple riders of a motion ride. All four steps are essential for completing the effect of creating the illusion of teleportation.

Conclusion

The current invention is a four step method and apparatus for a motion ride that creates the illusion of teleportation on a multiple of passengers in a passenger vehicle. Multiple embodiments of diverse type and use of apparatus are presented for completing the four steps of the method. The four step method is the most unique part of the current invention. This is in comparison to the use of apparatus like the passenger vehicle and the secondary environment which can be varied, as discussed previously in the three embodiments of the current invention. For example, the images of motion of the secondary environment can be real or artificially created. In both forms the secondary environment is presenting having a relative illusion of motion either by real images of the actual structure moving or by display panels presenting artificial images of motion. These artificial images of motion can be presented by a few display panels which can create an image of a window with an outside view of objects of the secondary environment moving or by display panels that cover the entire secondary environment creating the illusion of the entire secondary environment having motion. Furthermore, projection of images of motion can be accomplished by an array of instruments including optical projectors, light-emitting diodes, liquid crystal displays, plasma display panels, cathode ray tubes, and similar devices.

Accordingly, the reader will see that the three embodiments, as presented in this publication, confirm the unique and effective method of the current invention for creating the illusion of teleportation. Furthermore, while these embodiments use common apparatus found among modern motion rides, the four step method of the current invention is not exclusive to these apparatus. Other apparatus may be envisioned for operating the four step method as covered in the scope of claims of the current invention. Thus the scope of the embodiments should be determined by the appended claims and their legal equivalents, rather than by the examples given.

What is claimed is:

1. A method for creating an illusion of teleportation on a multiple of passengers within a passenger vehicle comprising: moving said passenger vehicle carrying said multiple of passengers through a primary environment with said primary environment in a field of vision of said multiple of passengers and with said primary environment being an area outside of a secondary environment; moving said passenger vehicle carrying said multiple of passengers out of said primary environment and into said secondary environment so that said primary environment is not within the field of vision of said multiple of passengers; moving said passenger vehicle carrying said multiple of passengers with a second velocity and moving said secondary environment in the field of vision of said multiple of passengers with a first velocity simultaneously for a finite amount of time with said first velocity of said secondary environment being relative to said second velocity of said passenger vehicle as selected from a group consisting of equal magnitude and same direction, equal magnitude and opposite direction, greater magnitude and same direction, greater magnitude and opposite direction, lesser magnitude and same direction, and lesser magnitude and opposite direction; and moving said passenger vehicle carrying said multiple of passengers out of said secondary environment and into said primary environment so that said primary environment is within the field of vision of said multiple of passengers; wherein moving said passenger vehicle carrying said multiple of passengers by said first means out of said primary environment and into said secondary environment further includes said secondary environment being a movable elevator shaft.

2. The method of claim 1, wherein said passenger vehicle carrying said multiple of passengers further includes said passenger vehicle being a ride elevator.

3. The method of claim 1, wherein moving said passenger vehicle carrying said multiple of passengers with a second velocity further includes moving said passenger vehicle by a cables and pulley system.

4. The method of claim 1, wherein moving said secondary environment in the field of vision of said multiple of passengers with a first velocity further includes moving said secondary environment by a cables and pulley system.

5. The method of claim 1, wherein moving said passenger vehicle carrying said multiple of passengers out of said primary environment and into said secondary environment further includes moving said passenger vehicle by a cables and pulley system.

6. The method of claim 1, wherein moving said passenger vehicle carrying said multiple of passengers out of said primary environment and into said secondary environment further includes said secondary environment being a movable elevator shaft with a movable elevator shaft platform housing multiple of a movable elevator shaft platform air fan, multiple of a movable elevator shaft platform light, and multiple of a movable elevator shaft platform speaker.

7. A method for creating an illusion of teleportation on a multiple of passengers within a passenger vehicle comprising: moving said passenger vehicle carrying said multiple of passengers by first means through a primary environment with said primary environment in a field of vision of said multiple of passengers and with said primary environment being an area outside of a secondary environment; moving said passenger vehicle carrying said multiple of passengers by said first means out of said primary environment and into said secondary environment so that said primary environment is not within the field of vision of said multiple of passengers; moving said passenger vehicle carrying said multiple of passengers by said second means with a second velocity and moving said secondary environment in the field of vision of said multiple of passengers by third means with a first velocity simultaneously for a finite amount of time with said first velocity of said secondary environment being relative to said second velocity of said passenger vehicle as selected from a group consisting of equal magnitude and same direction~equal magnitude and opposite direction, greater magnitude and same Patent Application of Daniel James Stoker for "Motion Ride Method and Apparatus for the Illusion of Teleportation" continued Page 49 direction, greater magnitude and opposite direction, lesser magnitude and same direction, and lesser magnitude and opposite direction; and moving said passenger vehicle carrying said multiple of passengers by said first means out of said secondary environment and into said primary environment so that said primary environment is within the field of vision of said multiple of passengers; wherein moving said passenger vehicle carrying said multiple of passengers by said first means out of said primary environment and into said secondary environment further includes said secondary environment being a movable elevator shaft.

8. The method of claim 7, wherein moving said secondary environment in the field of vision of said multiple of passengers by said third means further includes said third means being a cables and pulley system.

9. The method of claim 7, wherein moving said passenger vehicle carrying said multiple of passengers by said first means out of said primary environment and into said secondary environment further includes said secondary environment being a movable elevator shaft with a movable elevator shaft platform housing multiple of a movable elevator shaft platform air fan, multiple of a movable elevator shaft platform light, and multiple of a movable elevator shaft platform speaker.

* * * * *